US008919623B1

(12) United States Patent
Bergeron et al.

(10) Patent No.: US 8,919,623 B1
(45) Date of Patent: Dec. 30, 2014

(54) HANDS FREE BEVERAGE CARRIER THAT ATTACHES TO A PERSON'S CLOTHING OR A WEARABLE ACCESSORY

(71) Applicant: Guide's Choice Inc., Kenner, LA (US)

(72) Inventors: Victor James Bergeron, Ponchatoula, LA (US); Creighton Pier Ward, Kenner, LA (US); Mark J. Gabriel, Baton Rouge, LA (US); Clarence Barton Kemper, III, Baton Rouge, LA (US); Krista Wohlfeil, Baton Rouge, LA (US); Donald Scott Rogers, Lafayette, LA (US); Melissa B. Rogers, Lafayette, LA (US); Billy James McDonald, Lafayette, LA (US)

( * ) Notice: Subject to any disclaimer, the term of this patent is extended or adjusted under 35 U.S.C. 154(b) by 0 days.

(21) Appl. No.: 13/919,855

(22) Filed: Jun. 17, 2013

Related U.S. Application Data

(63) Continuation-in-part of application No. 13/433,622, filed on Mar. 29, 2012.

(60) Provisional application No. 61/468,919, filed on Mar. 29, 2011.

(51) Int. Cl.
*A45F 5/00* (2006.01)

(52) U.S. Cl.
USPC ..... 224/148.4; 224/158; 224/159

(58) Field of Classification Search
CPC ... A45F 5/00; A45C 2200/20; A45C 2200/05
See application file for complete search history.

(56) References Cited

U.S. PATENT DOCUMENTS

| | | | | | |
|---|---|---|---|---|---|
| 3,956,701 | A * | 5/1976 | James et al. | 343/702 |
| 4,419,794 | A * | 12/1983 | Horton et al. | 24/667 |
| 5,014,892 | A * | 5/1991 | Copeland | 224/271 |
| 5,054,170 | A * | 10/1991 | Otrusina | 24/580.11 |
| 5,375,749 | A * | 12/1994 | Oliva | 224/271 |
| 5,584,423 | A * | 12/1996 | Wang | 224/197 |
| 5,593,121 | A * | 1/1997 | Tackett | 248/218.4 |
| 5,604,958 | A * | 2/1997 | Anscher | 24/3.1 |
| 5,620,120 | A * | 4/1997 | Tien | 224/199 |
| 5,641,102 | A * | 6/1997 | Hellweg | 224/198 |
| 5,850,996 | A * | 12/1998 | Liang | 248/221.11 |
| 6,006,969 | A * | 12/1999 | Kim | 224/197 |
| 6,098,858 | A * | 8/2000 | Laugesen | 224/197 |
| 6,286,737 | B1 * | 9/2001 | Whitley | 224/271 |

(Continued)

*Primary Examiner* — Brian D Nash
(74) *Attorney, Agent, or Firm* — Garvey, Smith, Nehrbass & North, L.L.C.; Charles C. Garvey, Jr.; Vanessa M. D'Souza

(57) ABSTRACT

A beverage carriage if provided for wear around a user's waist area. The apparatus includes an accessory that attaches to a user's waist area. A hanger depends from the accessory, the hanger having an upwardly positioned socket. A mounted sleeve has a top opening having an opening that enables a contained beverage to be housed within the sleeve interior. A curved panel/plate fits inside the sleeve. A projecting member is attached to the curved panel/plate and extends through the insulated sleeve to a position spaced externally of the sleeve. A detachable connector joins the projecting member to the hanger when the detachable connector is lowered into the socket via the open top. A locking member moves between locking and release positions, the locking member automatically interlocking with the connector when the connector is lowered into the socket, the locking member having a manually operated release portion that when depressed by the hand of a user places the locking member in the released position which enables removal of the connector from the socket.

20 Claims, 22 Drawing Sheets

(56) References Cited

U.S. PATENT DOCUMENTS

| | | | | |
|---|---|---|---|---|
| 6,786,372 | B2 * | 9/2004 | Enkerlin et al. | 224/271 |
| 7,409,237 | B2 * | 8/2008 | Tages | 455/575.1 |
| 7,959,121 | B1 * | 6/2011 | Barnes, Jr. | 248/311.2 |
| 7,980,435 | B2 * | 7/2011 | Tages | 224/269 |
| 8,231,094 | B1 * | 7/2012 | Barnes, Jr. | 248/311.2 |
| 8,613,564 | B2 * | 12/2013 | Busch | 403/322.1 |
| 2010/0294816 | A1 * | 11/2010 | Sentell | 224/148.3 |
| 2014/0027477 | A1 * | 1/2014 | deBeers | 224/148.4 |
| 2014/0042195 | A1 * | 2/2014 | Geis et al. | 224/148.4 |

* cited by examiner

HANDS FREE BEVERAGE CARRIER THAT ATTACHES TO A PERSON'S CLOTHING OR A WEARABLE ACCESSORY

CROSS-REFERENCE TO RELATED APPLICATIONS

This is a continuation in part of U.S. patent application Ser. No. 13/433,622, filed 29 Mar. 2012, which is a non provisional patent application of U.S. Provisional Patent Application Ser. No. 61/468,919, filed 29 Mar. 2011.

Priority of U.S. Provisional Patent Application Ser. No. 61/468,919, filed 29 Mar. 2011, hereby incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to a carrier that enables a user to support a drink product (canned, bottled, etc.) at a position next to the user's waist or hip area such as upon a belt. More particularly, the present invention relates to an improved beverage carrier for wear at a user's hip or waist area or on an accessory (e.g., backpack, belt, shirt, jacket, vest, purse) wherein a spring loaded locking arrangement secures a specially configured insulated sleeve to a housing or receiver that is mounted on the user's belt or to the user's garment at the waist area, the sleeve supporting a selected beverage container and wherein a user can finger or thumb actuate a release mechanism that frees the sleeve and container from the receiver.

2. General Background of the Invention

Drink products are often carried by individuals over long distances. Hikers, athletes, sports fans, parade attendees, hunters, fishermen, and outdoor workers all carry drink products which must be hand held if another provision is not made for carriage.

BRIEF SUMMARY OF THE INVENTION

The present invention provides a beverage carrier for wear around a user's torso. This carriage apparatus enables a user to support a selected beverage container upon a user's torso, hip or at the waist area, thus freeing the user's hands when the beverage is not being consumed.

The present invention includes a beverage carriage for wear upon a user's body, comprising a clothing accessory that attaches to a user's body, a receiver that depends from the accessory, the receiver having an upwardly positioned socket, a mounted sleeve having a top opening and an interior, said opening enabling a contained beverage to be housed within the sleeve interior, a curved panel that fits inside the sleeve, a projecting member attached to the curved panel and extending through the sleeve to a position spaced externally of the sleeve, a detachable connector that joins the projecting member to the receiver when the detachable connector is lowered into the socket via the open top to define a pivotal connection, a locking member that moves between locking and release positions, the locking member automatically interlocking with the connector when the connector is lowered into the socket, the locking member having a manually operated release portion that when depressed by the hand of a user places the locking member in the release position which enables removal of the connector from the socket, and a cam that depresses the release portion when the sleeve is rotated about said pivotal connection a selected number of degrees that is between about 5 degrees and 90 degrees.

In one embodiment, the locking member is spring loaded.

In one embodiment, the locking member has a cam that moves the locking member laterally away from the socket when the projecting member is lowered into the socket.

In one embodiment, there is a second curved panel that attaches to the outside surface of the sleeve.

In one embodiment, the projecting member has an annular flange and an annular recess.

In one embodiment, the locking member is moved by the projecting member when the projecting member is joined to the receiver.

In one embodiment, the locking member is positioned above the projecting member in the locking position.

In one embodiment, the locking member moves laterally when the release portion is depressed.

In one embodiment, the receiver has a cover and the locking member is a part of the cover.

The present invention includes a beverage carriage for wear upon a user's body comprising an article of clothing that is wearable by a user, a receiver that is removably attachable to the article of clothing, the receiver having a socket, a mounted sleeve having a top opening and an interior, said opening enabling a contained beverage to be housed within the sleeve interior, a first panel that fits inside the sleeve, the sleeve being of a material that is softer than the first panel, a projecting member attached to the first panel and extending through the sleeve to a position spaced externally of the sleeve, a second panel that connects to the projecting member on the outside of the sleeve, a connector that joins the projecting member to the receiver when the detachable connector is lowered into the socket via the open top to define a pivotal connection of the sleeve relative to the receiver, a locking member that moves between locking and release positions, the locking member automatically interlocking with the connector when the connector is lowered into the socket, the locking member having a manually operated release portion that when depressed by the hand of a user places the locking member in the release position which release position enables removal of the connector from the socket, and a cam that depresses the release portion when the sleeve is rotated about said pivotal connection a selected number of degrees that is between about 5 degrees and 90 degrees.

In one embodiment, the locking member includes a biasing means that biases the locking member towards a locking position.

In one embodiment, when the projecting member is lowered into the socket, the locking member moves the locking member laterally away from the socket.

In one embodiment, at least one of the panels has spikes that engage the sleeve.

In one embodiment, the projecting member has an annular flange and an annular recess, the annular recess being closer to the sleeve than the annular flange.

The present invention includes a beverage carriage for wear upon a user's body comprising a clothing accessory that attaches to a user's body, a receiver that depends from the accessory, the receiver having an upwardly positioned socket, a mounted sleeve having a top opening and an interior, said opening enabling a contained beverage to be housed within the sleeve interior, an inner panel that fits inside the sleeve, a projecting member attached to the inner panel and extending through the sleeve to a position spaced externally of the sleeve, an outer panel that attaches to the projecting member externally of the sleeve, and wherein the inner and outer panels sandwich the sleeve therebetween, a detachable connector that joins the projecting member to the receiver to form a pivotal connection when the detachable connector is lowered into the socket via the open top, and a locking member that moves between locking and release positions, the locking member automatically interlocking with the connector when the connector is lowered into the socket, the locking member having an operated release portion that when depressed places the locking member in the release position which enables removal of the connector from the socket, and a cam that depresses the release portion when the sleeve is rotated at the pivotal connection a measure of between about 10 and 90 degrees.

In one embodiment, the locking member moves the locking member laterally away from the socket when the projecting member is lowered into the socket.

In one embodiment, there is at least one of the panels is curved.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
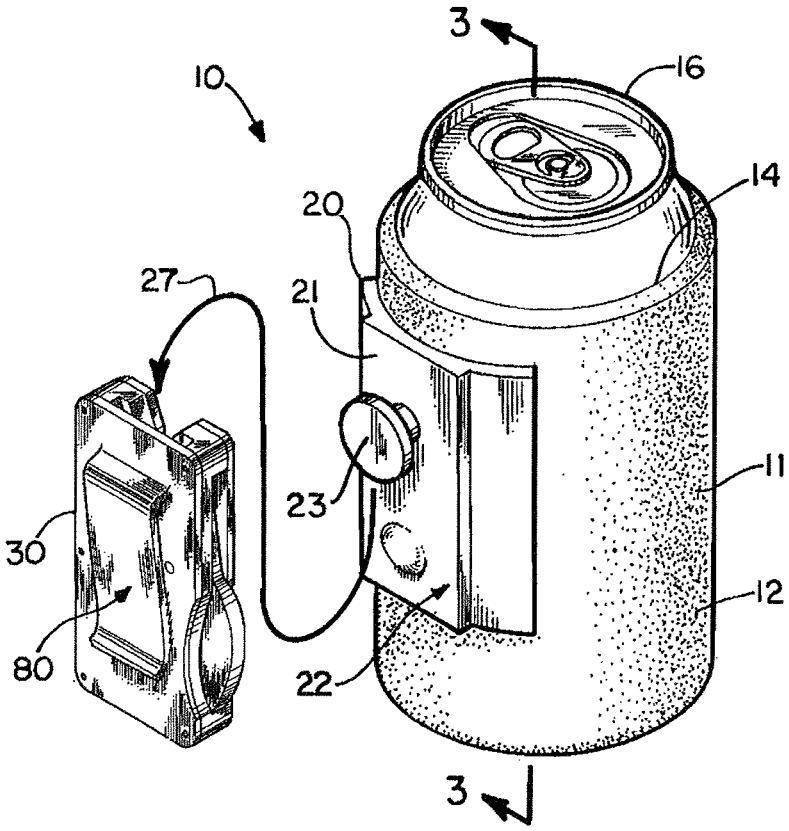
FIG. 1 is a perspective view of a preferred embodiment of the apparatus of the present invention.

FIGS. 1-14 show a preferred embodiment of the apparatus of the present invention designated generally by the numeral 10. Beverage carrier 10 employs a generally cylindrically shaped sleeve 11 which can be insulated. Sleeve 11 can be made of closed cell foam. The insulated sleeve 11 can have a cylindrical wall 12 and a circular bottom or end panel 13. Sleeve 11 could be substituted with another sleeve, using a sleeve 29 or 45 as examples.

Sleeve 11 has an open top 14 for enabling the placement of a selected drink product (such as a canned drink product or a bottled drink product) into the interior 15 of the insulated sleeve 11 via the open top 14.

Figure 12:
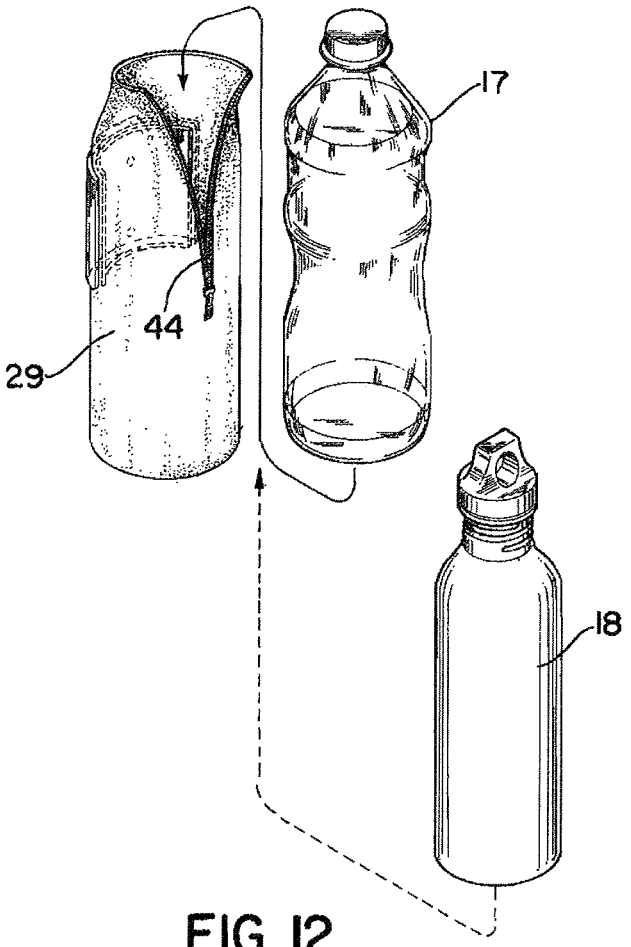
FIG. 12 is a perspective exploded view of a preferred embodiment of the apparatus of the present invention showing the sleeve portion when the sleeve is a zippered insulated sleeve.
Figure 13:
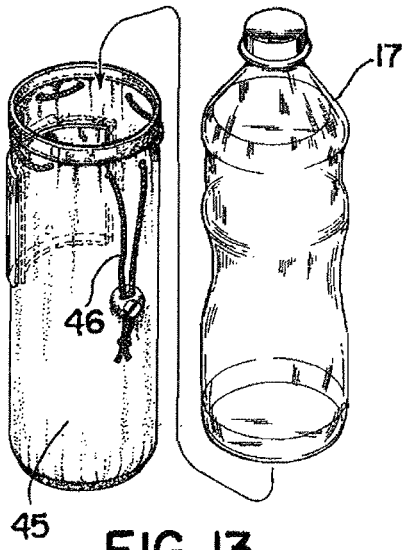
FIGS. 13-14 are perspective views of a preferred embodiment of the apparatus of the present invention illustrating an insulated drawstring closure for a sleeve or bag.
Figure 14:
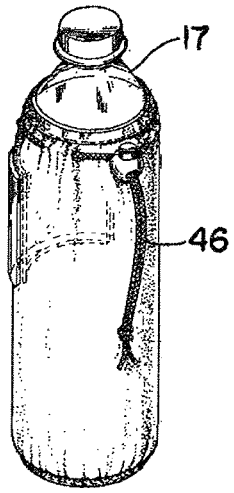
Figure 15:
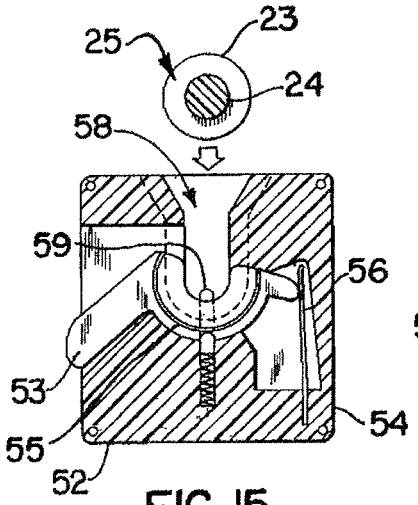
FIGS. 15-18 are sectional fragmentary views of a preferred embodiment of the apparatus of the present invention illustrating an alternate locking arrangement.
Figure 16:
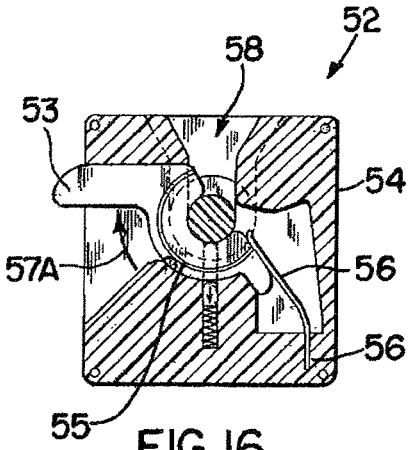
Figure 17:
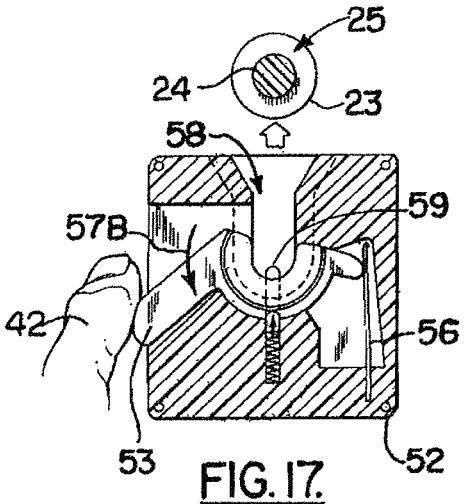
Figure 18:
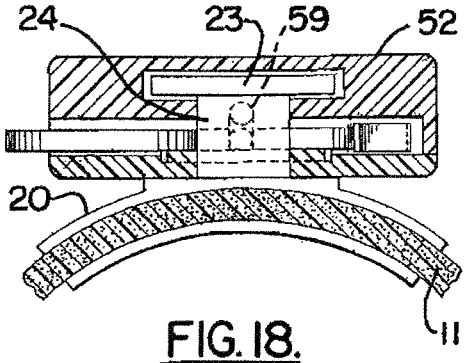
Figure 19:
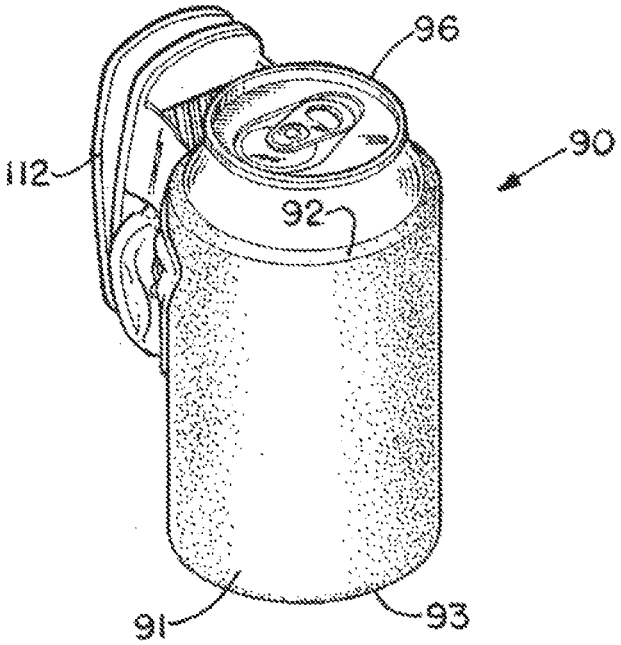
FIG. 19 is a perspective view a third embodiment of the apparatus of the present invention.
Figure 20:
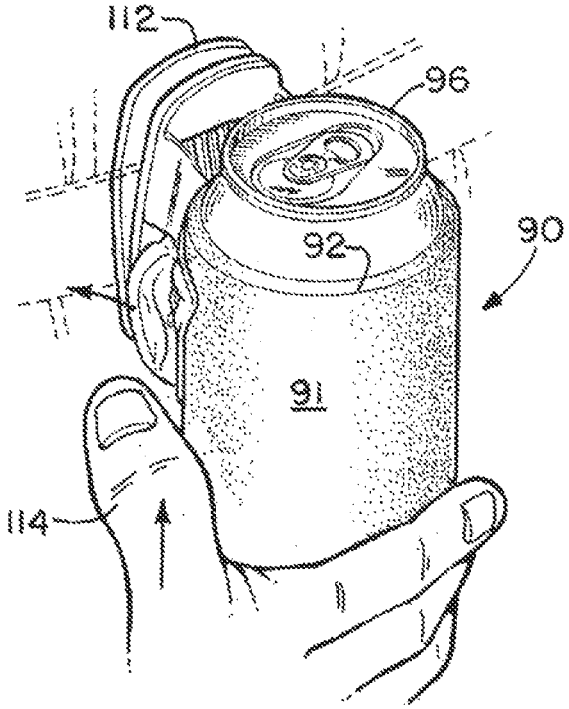
FIG. 20 is a perspective view of a third embodiment of the apparatus of the present invention.

In the drawings, a beverage container in the form of a can 16 is shown. However, in any embodiment of FIGS. 1-27, the container can be a can, bottle or other container. A beverage container in the form of a disposable bottle is also shown, designated by the number 17. Beverage container 18 shows another type of beverage container in the form of a metal bottle that is a reusable container. In FIGS. 12-14, alternate sleeves 29, 45 are shown holding containers 17, 18. Zippered sleeve 29 can be opened and closed to insert or remove a container 17 or 18 using zipper 44. Sleeve 45 can be opened or closed to insert or remove a container 17 or 18 using drawstring 46.

The parts described herein can be made from injection molded plastic. In FIGS. 1-5, the sleeve 11 provides an inner curved panel 19 and outer curved panel 20. Inner curved panel 19 can be a full cylinder that extends completely around the container 16, 17, and 18. Alternatively, the inner curved panel 19 can extend partially around the container 16, 17, 18 such as about 40-180 degrees around container 16, 17, 18. A thickened section 21 is provided on the outer curve panel 20. This thickened section 21 can provide a flat surface 22 to which is supported a projecting portion or disk 23. Connecting portion 24 joins disk 23 to flat surface 22.

An annular recess 25 is provided around connecting portion 24 and in between disk 23 and flat surface 22. This annular recess 25 is receptive of a receiver 30 as will be described more fully hereinafter. Fasteners 26 (e.g., pins, screws, rivets, bolts or the like) join panel/plate 19 to panel/plate 20 as shown.

Figure 2:
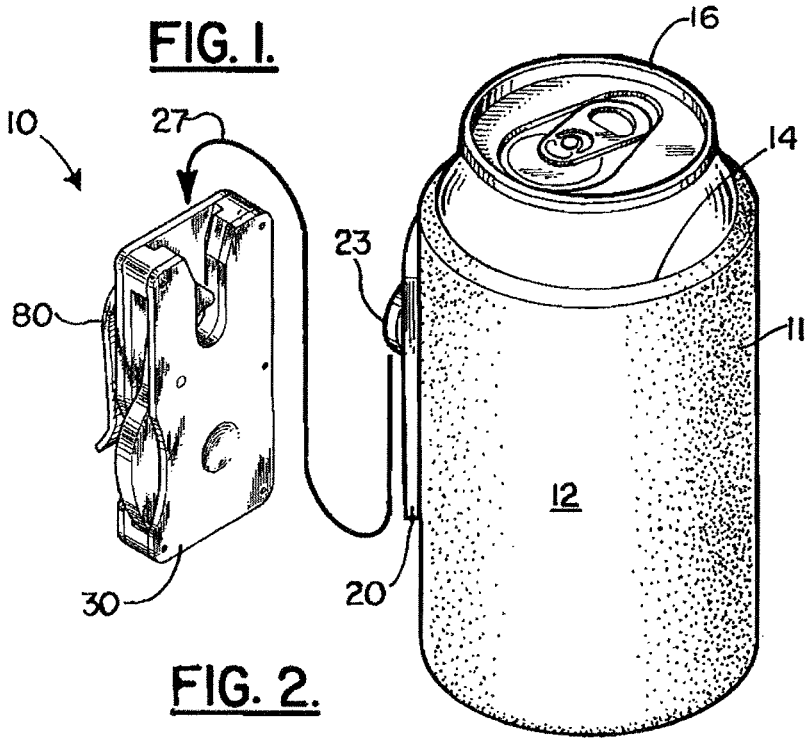
FIG. 2 is a perspective view of a preferred embodiment of the apparatus of the present invention.
Figure 3:
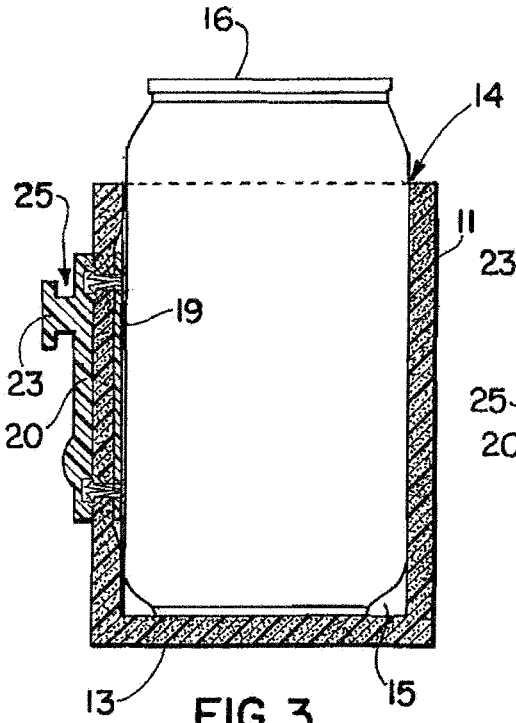
FIG. 3 is a sectional view taken along the lines 3-3 of FIG. 1.
Figure 4:
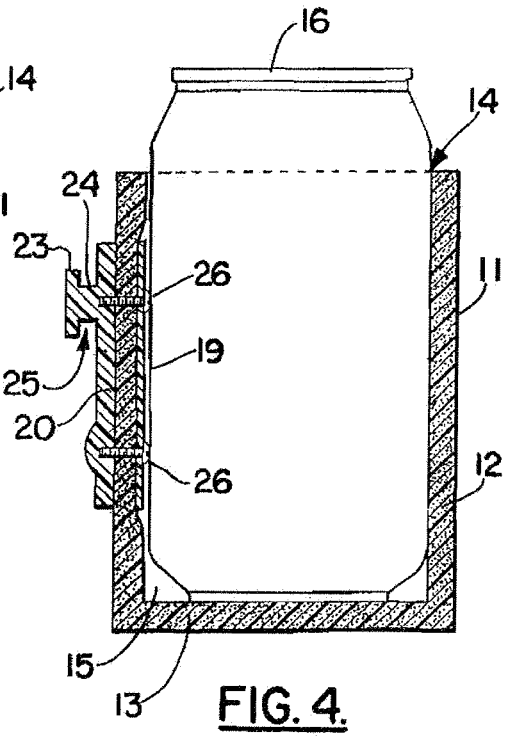
FIG. 4 is a sectional view of a preferred embodiment of the apparatus of the present invention.
Figure 5:
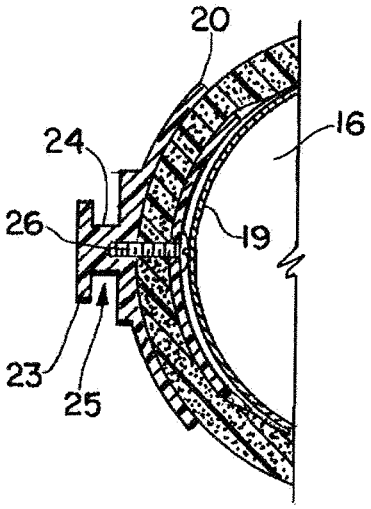
FIG. 5 is a top partial sectional view of a preferred embodiment of the apparatus of the present invention.

In FIGS. 1 and 2, arrow 27 illustrates the placement of disk 23 into the receiver, holder, or receptacle 30. This action is seen more clearly in FIGS. 6-11. Receiver 30 provides a housing 31 having a locking member 32 that is mounted to the housing 31 with a pivotal connection or pivot 33. Locking member 32 has an upper end portion 34 with a projection 35. The locking member 32 has a lower end portion 36 with a cam 37. A spring 38 is provided for urging the locking member 32 into the locking position of FIGS. 6 and 9 (see arrow 41). Spring 38 can be attached to housing 31 using spring attachment 39 which can be a pair of fasteners as shown.

Figure 6:
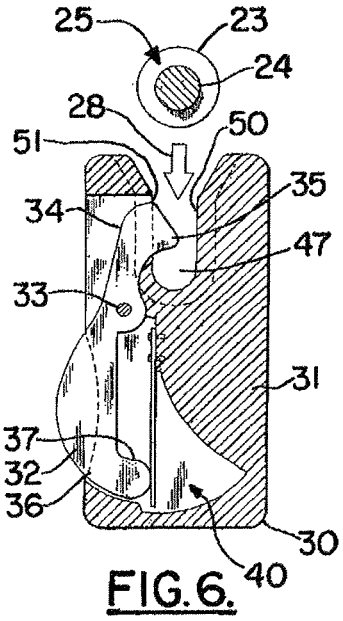
FIGS. 6-11 are sectional elevational views illustrating the receiver and connection thereto of the disk or projecting portion of the insulated sleeve.
Figure 7:
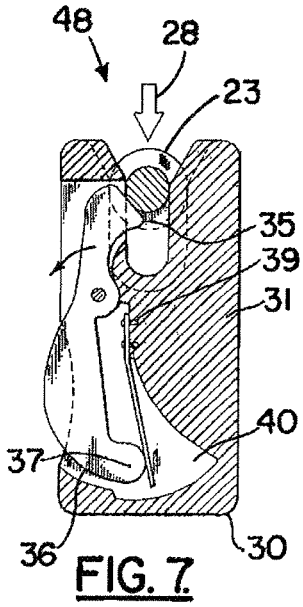
Figure 8:
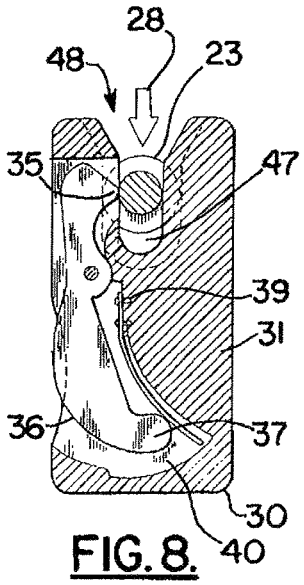

The locking member 32 is mounted to travel within a recess or slot 40 of housing 31. In FIGS. 6-8, arrows 28 illustrate the insertion of disk or projecting member 23 into recess 47 via its open top 48. While the disk or projecting member 23 and the connecting portion or shaft 24 are the only portions of insulated sleeve 11 shown in FIGS. 6-11, it will be understood that the connection portion 24 is joined to curve panel/plate 20 and thus to sleeve 11 and the contained beverage or can 16.

Figure 9:
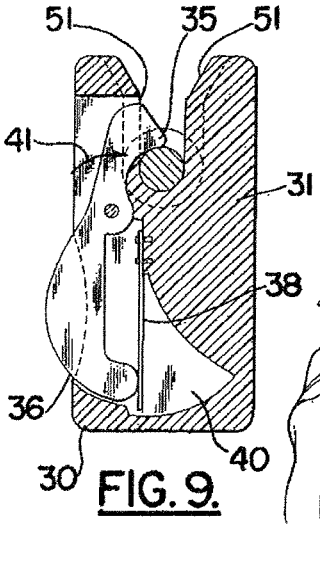
Figure 10:
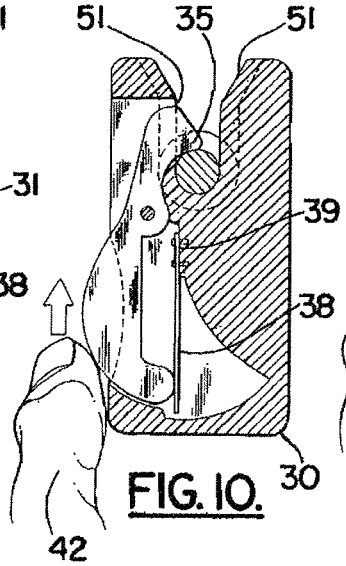
Figure 11:
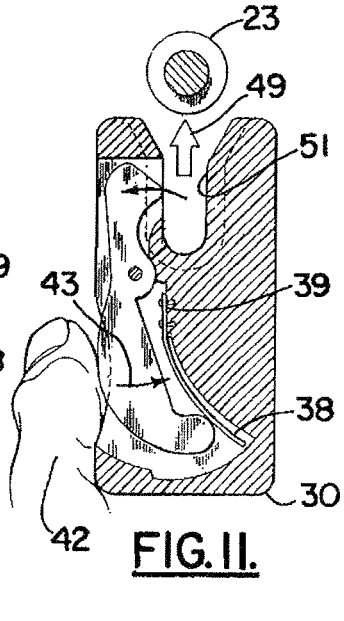

Receiver 30 housing 31 has a flange 50 with edges 51 that travel in annular recess 25 as see in FIGS. 1-11. In order to release the beverage can or other container 16 and sleeve 11 from recess 47, a user simply uses his or her finger or thumb 42 to press inwardly on the lower end portion 36 of locking member 32 in the direction of arrow 43 as shown in FIG. 11. This action rotates the lower end portion 36 of the locking member 32 inwardly toward spring 38, thus overcoming spring pressure of spring 38. Locking member 32 rotates about pivot 33, withdrawing projecting portion 35 of locking member 32 from recess 47 as shown in FIGS. 9-11. A user can then lift the container 16, sleeve 11 and disk 23 upwardly as illustrated by arrow 49 in FIG. 11. Receiver 30 housing 31 can have a clasp 80 for enabling attachment to a belt, accessory, backpack or item of clothing.

FIGS. 15-18 show a different locking arrangement for the receiver, designated as numeral 52. In FIGS. 15-18, receiver 52 supports arm 53 which is pivotally attached to receiver body 54 at pivotal or rotary connection 55. When connecting portion 24 and disk 23 enter socket 58, spring 56 is pushed which frees arm 53 to rotate to the locking position of FIG. 16. Arm 53 is rotated in the direction of arrow 57A until arm 53 partially enters recess or socket 58 thus preventing removal of disk 23 (see FIG. 16). In order to release disk 23 and the attached sleeve 11, a user uses his or her thumb or finger 42 to rotate the arm 53 in the direction of arrow 57B to compress spring 56 (see FIGS. 15, 17). Locking pin 59 can be compressed by connecting portion 24 or disk 23 to enable rotation of arm 53. Until pin 59 is depressed, arm 53 remains in the unlocked position of FIG. 15. Pin 59 can be spring loaded to remain in the extended position of FIG. 15. Once connecting portion 24 or disk 23 pushes pin 59 downwardly, arm 53 is free to rotate in the direction of arrow 57A.

FIGS. 19-30 show a third embodiment of the apparatus of the present invention designated generally by the numeral 90.

Beverage carrier assembly 90 provides an insulated receptacle 91 which can be for example of a closed cell phone construction. Insulated receptacle 91 provides a cylindrical wall 92, circular bottom 93 and open top 94. An interior 95 is provided that is receptive of a beverage container such as a can or a bottle, designated by the numeral 96 in FIGS. 19-21.

Figure 22:
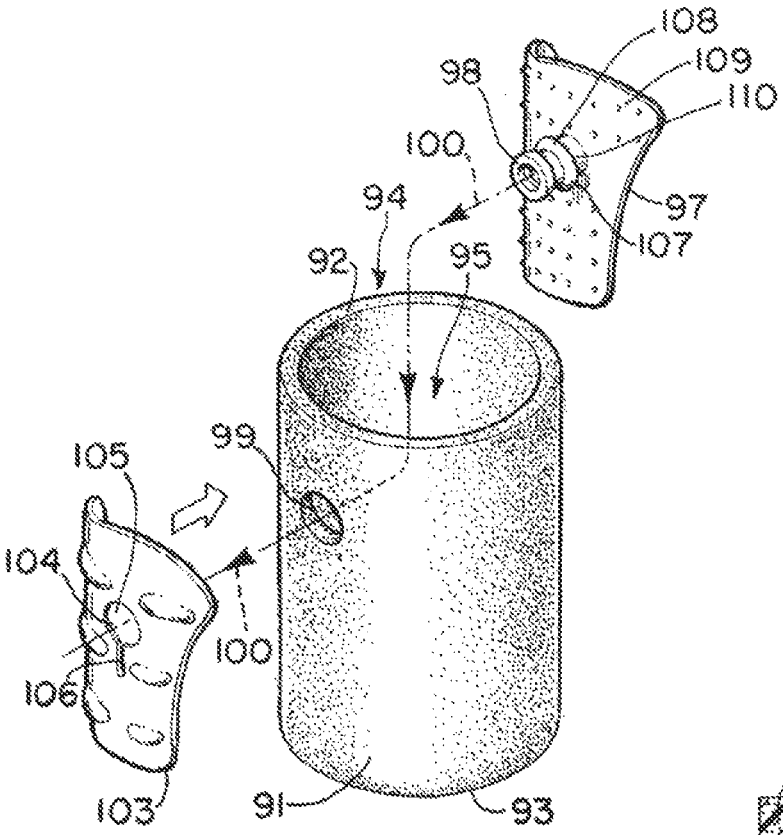
FIG. 22 is an exploded partial perspective view of a third embodiment of the apparatus of the present invention.
Figure 23:
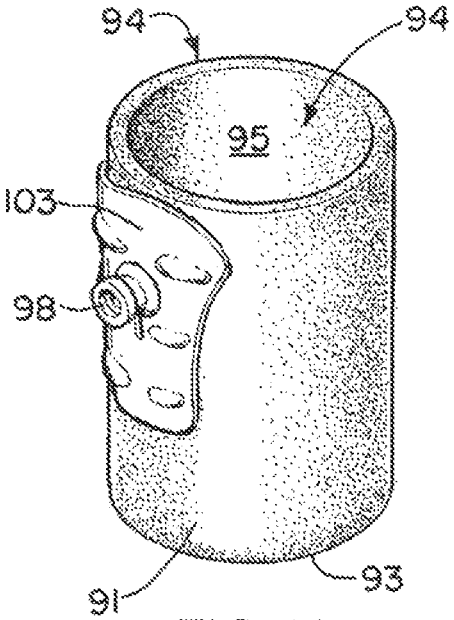
FIG. 23 is a partial perspective view of a third embodiment of the apparatus of the present invention.
Figure 24:
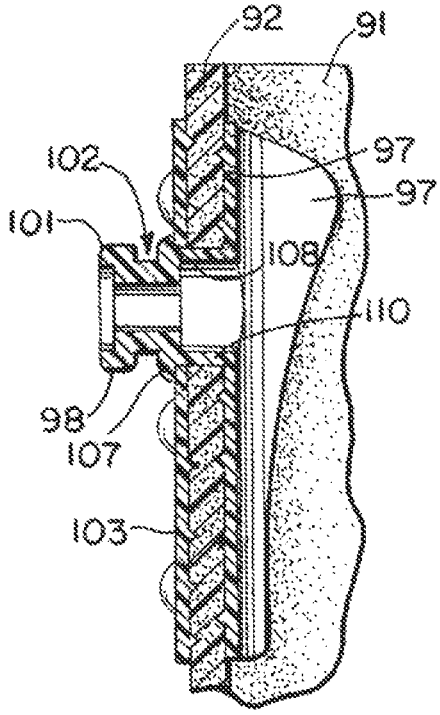
FIG. 24 is a partial sectional view of a third embodiment of the apparatus of the present invention.

An inner curved plate 97 is placed inside interior 95, engaging the inner surface of cylindrical wall 92 as shown in FIGS. 22-24. The inner curved plate 97 carries a projecting member 98 which is used to form a locking connection with a clothing or belt mounted receptacle or holder 112 as will be discussed more fully hereinafter. Projecting member 98 extends from plate 97 through opening 99 in the cylindrical wall 92 of insulated receptacle 91. The projecting member 98 then forms a connection with outer curved plate 103 at opening 104. Opening 104 can include a circular portion 105 and an elongated slot 106. In FIG. 22, arrows 100 schematically illustrate the assembly of inner curved plate 97, insulated receptacle 91, and outer curved plate 103.

Projecting member 98 includes an outer annular flange 101, outer annular recess 102, inner annular flange 107, and inner annular recess 108. The inner annular flange 107 and inner annular recess 108 enable a connection to be formed with plate 103 as the opening 104 circular portion 105 is of a diameter that is smaller than the diameter of inner annular flange 107. Thus, the inner annular flange 107 captures the plate 103 behind it and in between inner annular flange 107 and cylindrical wall 92 of insulated receptacle 91. This arrangement is best seen in FIGS. 22-24.

The plates 97 and 103 can be provided with teeth or projecting portions or projections 109 that are positioned to engage cylindrical wall 92. Projecting member 98 has a cylindrical portion 110 that occupies opening 99 as shown in FIG. 24 when the inner curved plate 97 and its projection 98 are inserted connect with plate 103 after the projecting member 98 is placed through opening 99.

Figure 21:
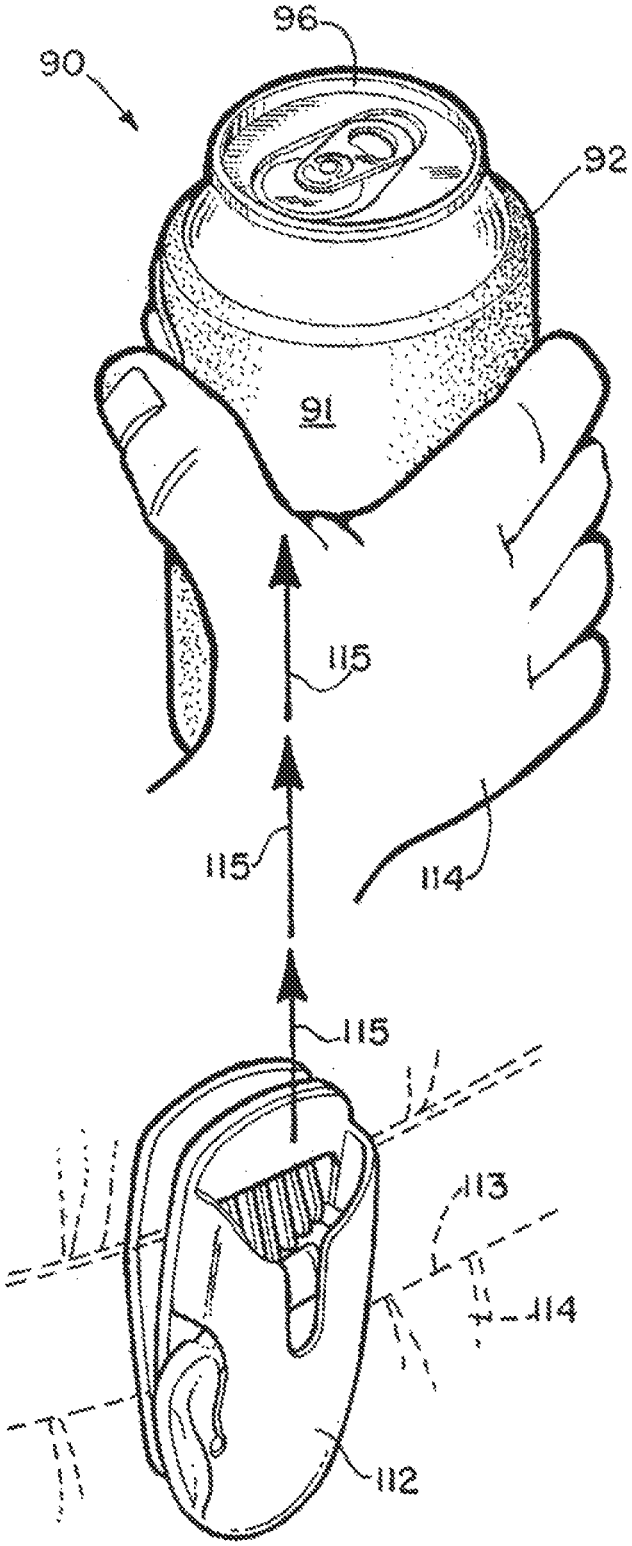
FIG. 21 is a perspective view of a third embodiment of the apparatus of the present invention.
Figure 25:
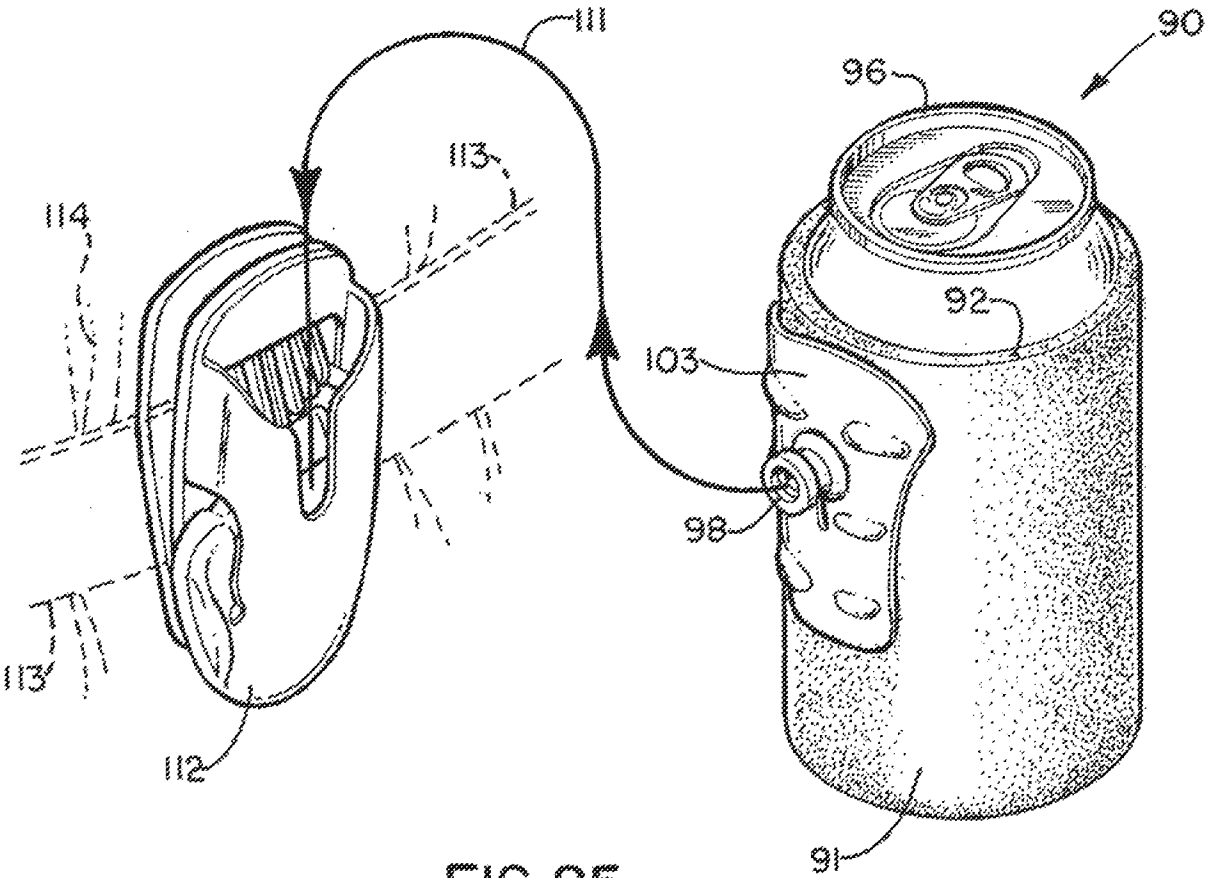
FIG. 25 is a perspective view of a third embodiment of the apparatus of the present invention.

A receptacle or holder 112 can be mounted on a user or wearers 114 belt 113. Arrow 111 in FIG. 25 illustrates an attachment of insulated receptacle 91 holding a beverage container or can 96 to receptacle or holder 112. Arrow 115 in FIG. 21 illustrates a removal of insulated receptacle 91 from receptacle of holder 112.

Figure 26:
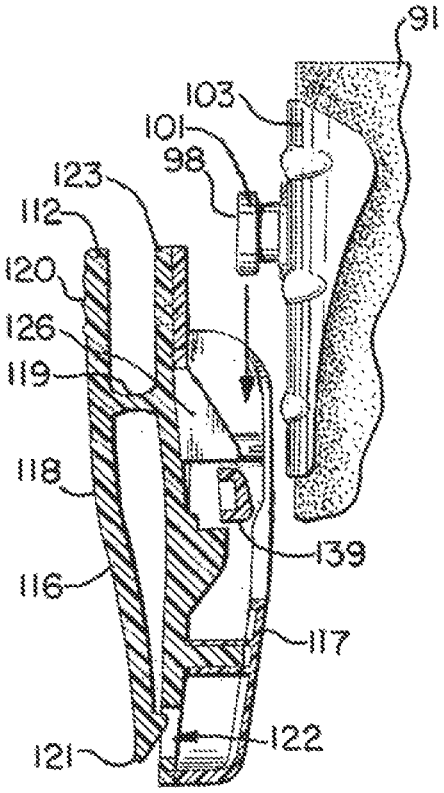
FIGS. 26-28 are sectional views illustrating operation of a third embodiment of the apparatus of the present invention.
Figure 27:
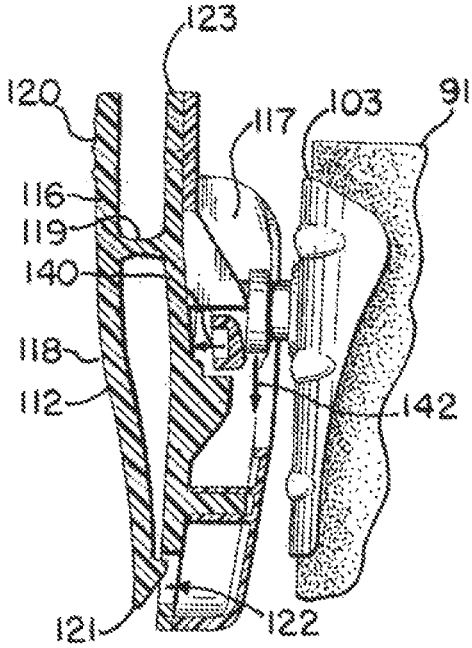
Figure 28:
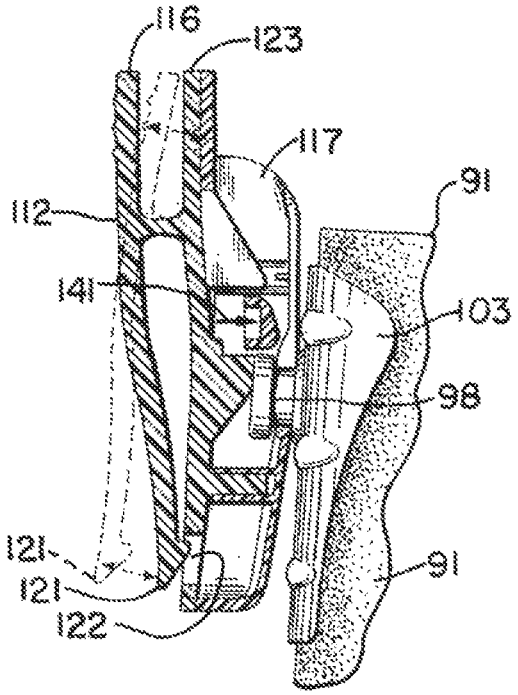
Figure 29:
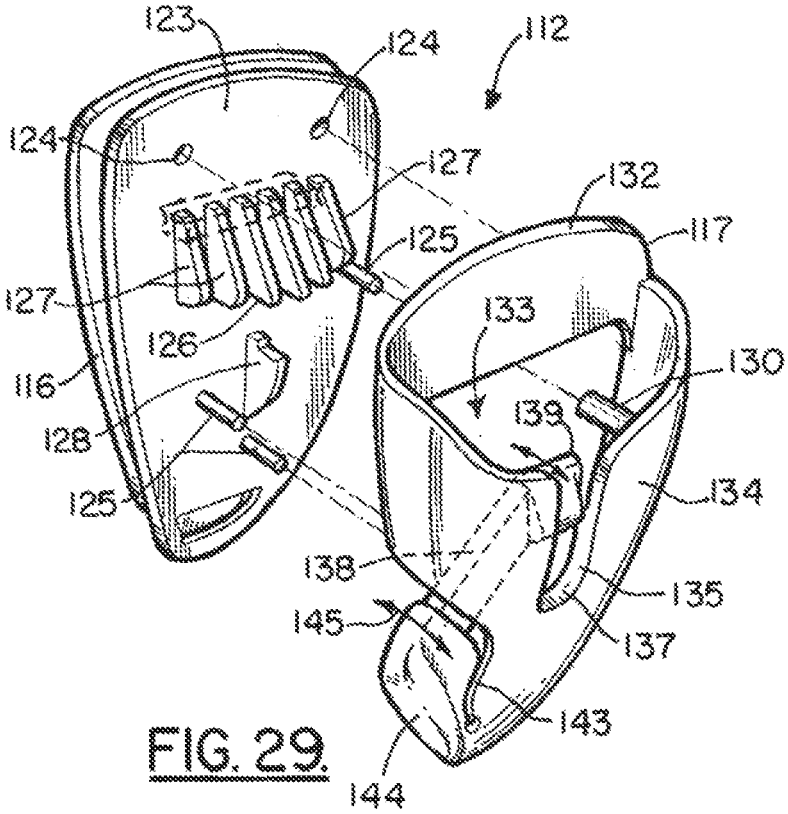
FIGS. 29 and 30 are partial perspective views of a third embodiment of the apparatus of the present invention.
Figure 30:
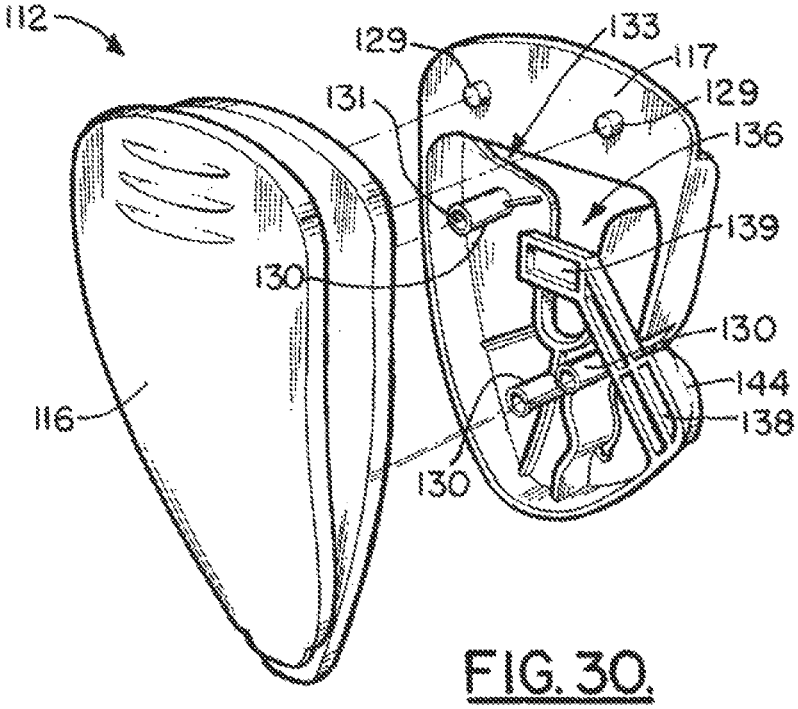
Figure 31:
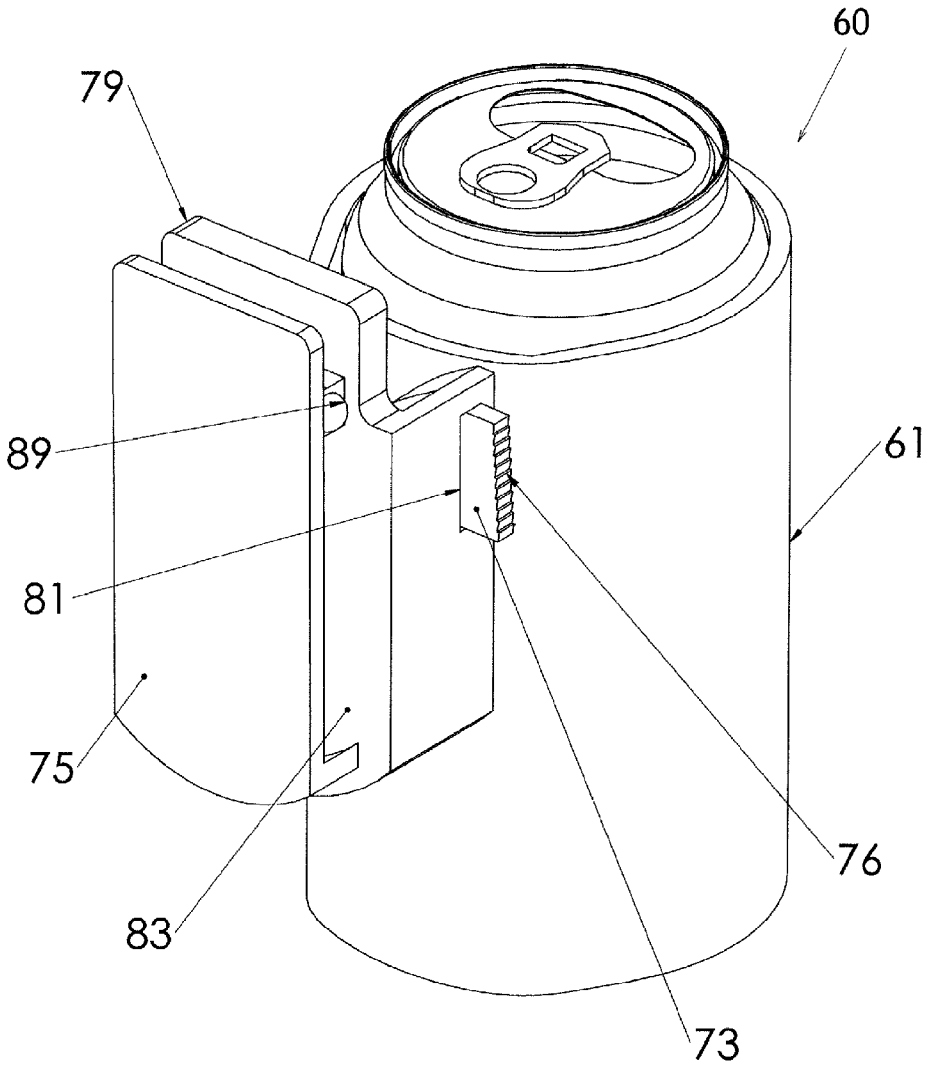
FIG. 31 is a perspective view of a fourth embodiment of the apparatus of the present invention.
Figure 32:
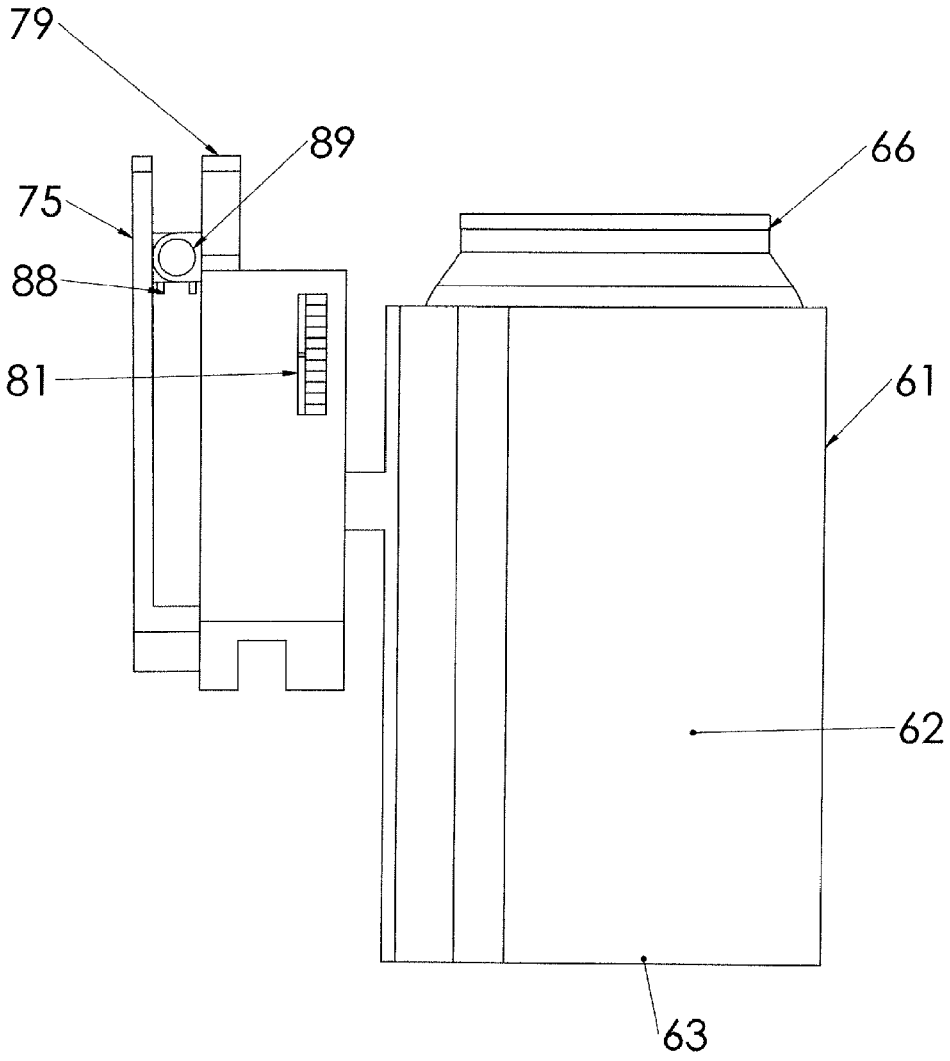
FIG. 32 is an elevation view of a fourth embodiment of the apparatus of the present invention.
Figure 33:
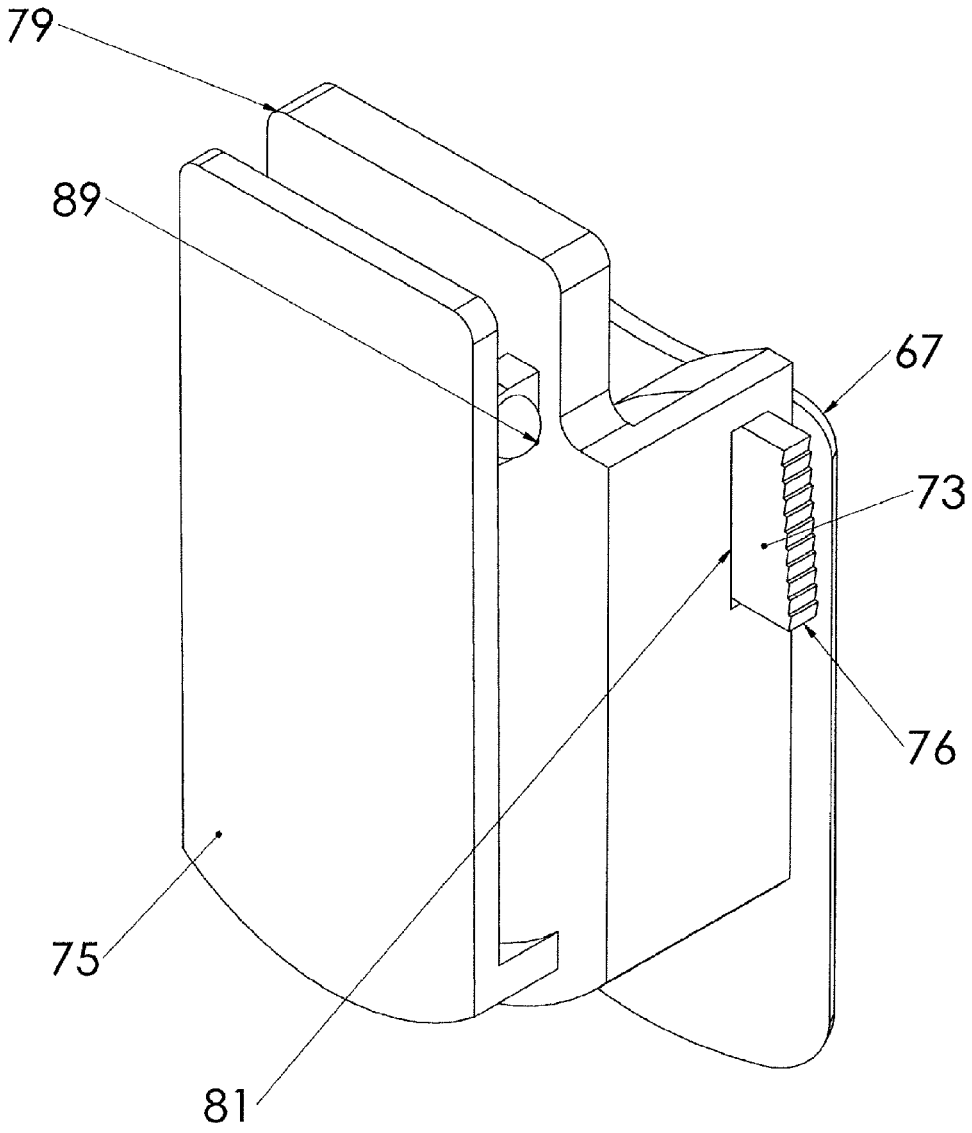
FIG. 33 is a fragmentary perspective view of a fourth embodiment of the apparatus of the present invention.

FIGS. 26, 27 and 28 illustrate a connecting of insulated receptacle, 91 to receptacle or holder 112. In FIGS. 29 and 30, receptacle, receiver, or holder 112 includes inner part 116 and an outer part 117. Inner part 116 carries a spring 118. Spring 118 is attached with hinge 119 to plate 123. Spring 118 enables connection to a user's clothing or belt 113 by depressing push button 120 which moves hook 121 away from opening 122, thus separating hook 121 from plate 123 as shown in FIG. 28. By releasing the push button 120, the hook 121 returns to the position shown in hard lines in FIG. 28, thus capturing the article of clothing, strap or belt 113 in between the spring 118 and plate 123.

Inner part 116 is attached to outer part 117 using a plurality of pins and openings. Pins 125 on inner part 116 engage the bore 131 of each sleeve 130 on outer part 117. Pins 129 on outer part 117 engage openings 124 on inner part 116. The connections of the pins 125, 129 to the openings 124, 131 can be interference fits.

The inner part 116 provides a ramp 126 defined by a plurality of triangular members 127. Spaced below ramp 126 is stop 128. A gap in between the stop 128 and the ramp 126 is occupied by upper end 139 of locking arm 138 as shown in FIGS. 26-30. Ramp 126 is engaged by outer annular flange 101 of projecting member 98 when insulated receptacle 91 moves downwardly toward slot 135 of cover 132 and more particularly its curved wall 134.

Cover 132 provides curved front wall 134. An opening 133 and slot 135 are provided to cover 132 front wall 134 having open top 136 and bottom or stop 137. When the projecting member 98 moves to the bottom or stop 137, locking arm 138 upper end 139 moves in the direction of arrow 141 to trap projecting member 98 below upper end 139 as shown in FIG. 28. In this fashion, a user can walk about briskly without fear that his or her beverage container 96 will be inadvertently dislodged and dropped or lost. Arrow 140 in FIG. 27 illustrates that upper end 139 moves away from projecting member 98 as the projecting member 98 moves downwardly in the direction of arrow 142 as seen in FIG. 27. In order to release projecting member 98, a user depresses actuator button 144 which is a part of cover 132 as shown in FIGS. 29 and 30. A slot 143 is provided in cover 132 as shown in FIG. 29 for enhancing the ability of actuator button 144 to move forward and rearward as illustrated by arrow 145 in FIG. 29.

FIGS. 31-40 show another fourth alternate embodiment of the apparatus of the present invention designated generally by the numeral 60. In FIGS. 31-40, beverage carrier 60 provides an insulated sleeve 61 that can include a cylindrical wall 62 in a circular bottom 63 with an open top 64. The open top 64 enables insertion of a can or container 66 into interior 65 of insulated sleeve 61. Similarly, a bottle 72 could be placed via open top 64 into interior 65 of insulated sleeve 61.

Figure 34:
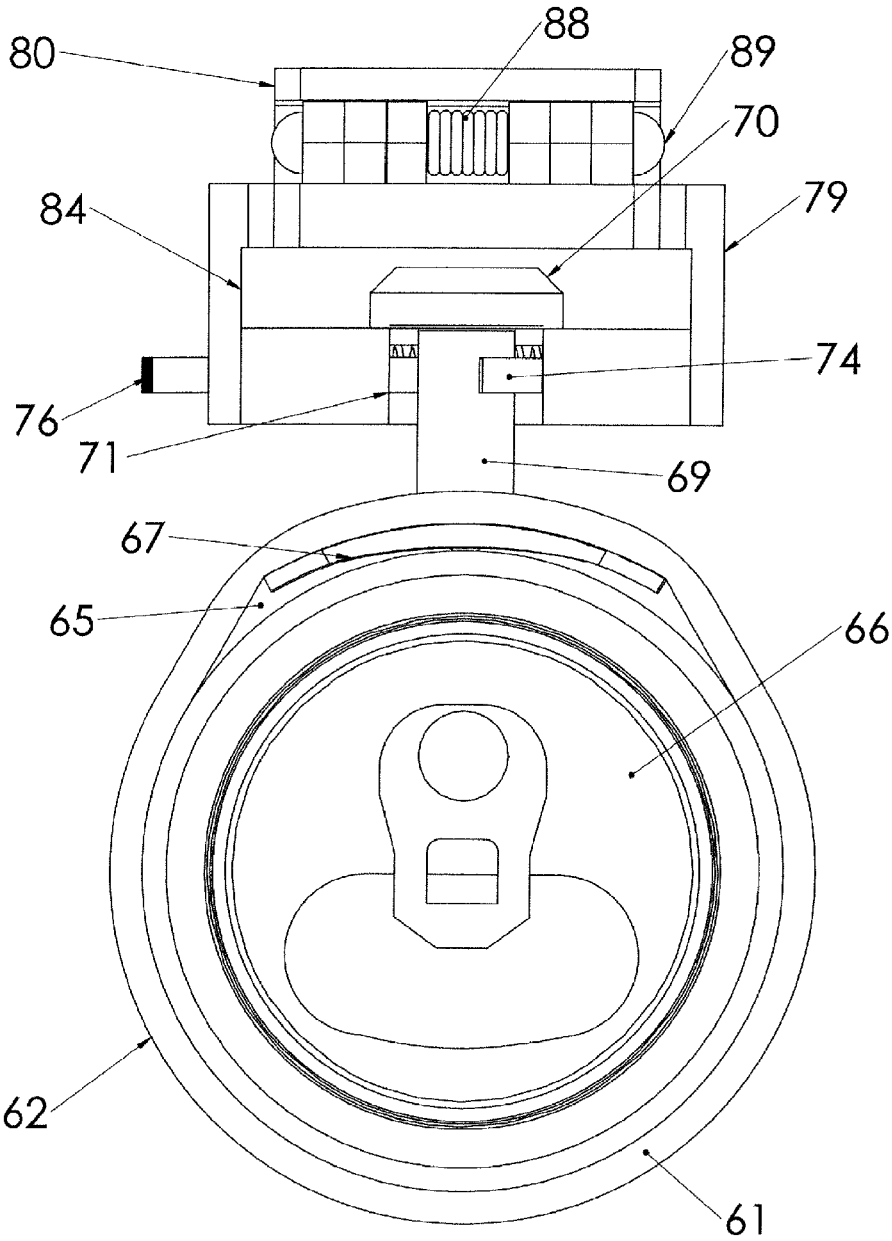
FIG. 34 is a plan view of a fourth embodiment of the apparatus of the present invention.

A curved plate 67 is positioned within interior 65 of insulated sleeve 61 as shown in FIG. 34. Projecting member 69 is attached to curve plate 67 using a fastener 68 such as a screw or bolt. Projecting member 69 is attached to circular disk 70 which is spaced away from plate 67 as shown in FIG. 34. An annular recess or groove 71 is provided around projecting member 69 and generally in between disk 70 and plate 67. This annular recess 71 is receptive of a locking plate 73 for holding the projecting member 69, disk 70 and thus, the attached sleeve 61 and its container 66 or 72 on the hip area of a user. The apparatus 60 can thus be carried on the torso, hip or waist area, clothing item, accessory, of a user by threading a belt or strap or other structure through recess 83 which is in between housing sections 79, 80. Parts 79,80 can be hingedly attached at pivot 89 and spring loaded (e.g. spring 88) to easily open and close around a belt, strap, accessory. Spring 88 is shown in FIG. 36.

Figure 35:
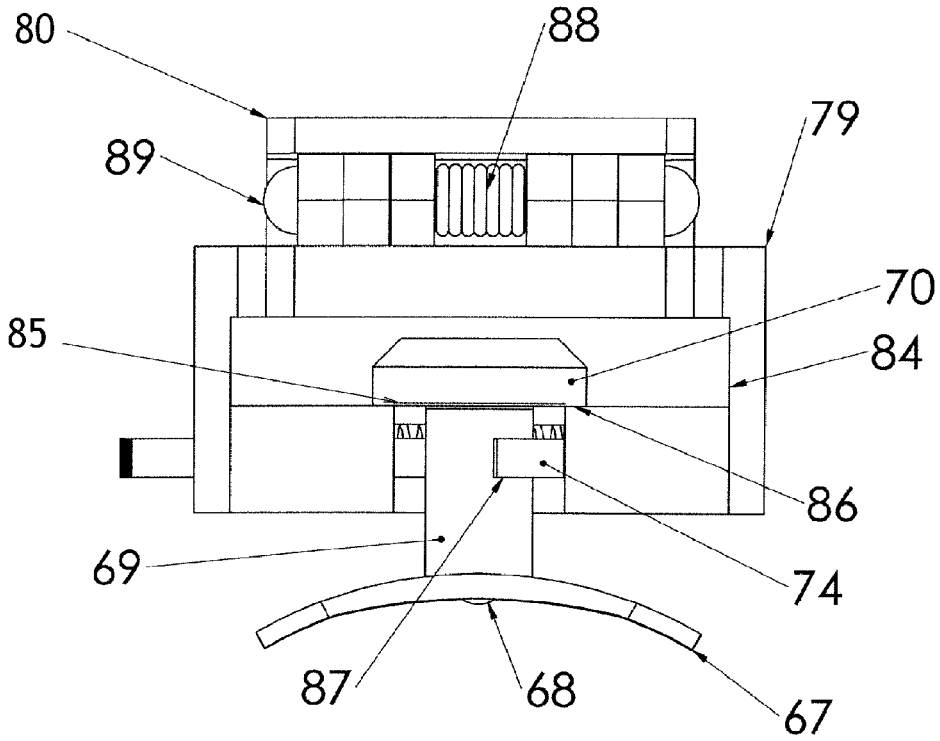
FIG. 35 is a partial plan view of a fourth embodiment of the apparatus of the present invention.
Figure 36:
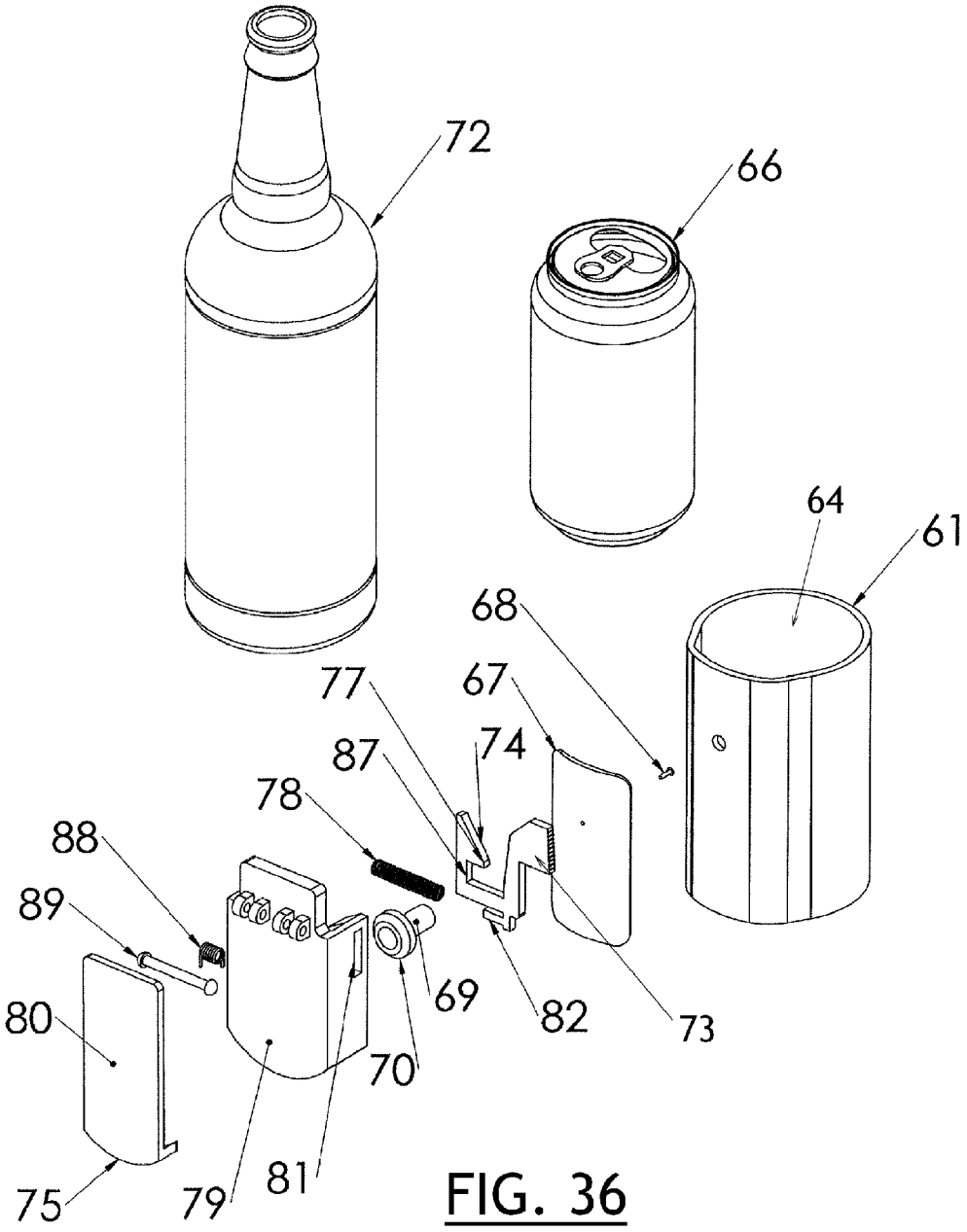
FIG. 36 is an exploded view of a fourth embodiment of the apparatus of the present invention.
Figure 37:
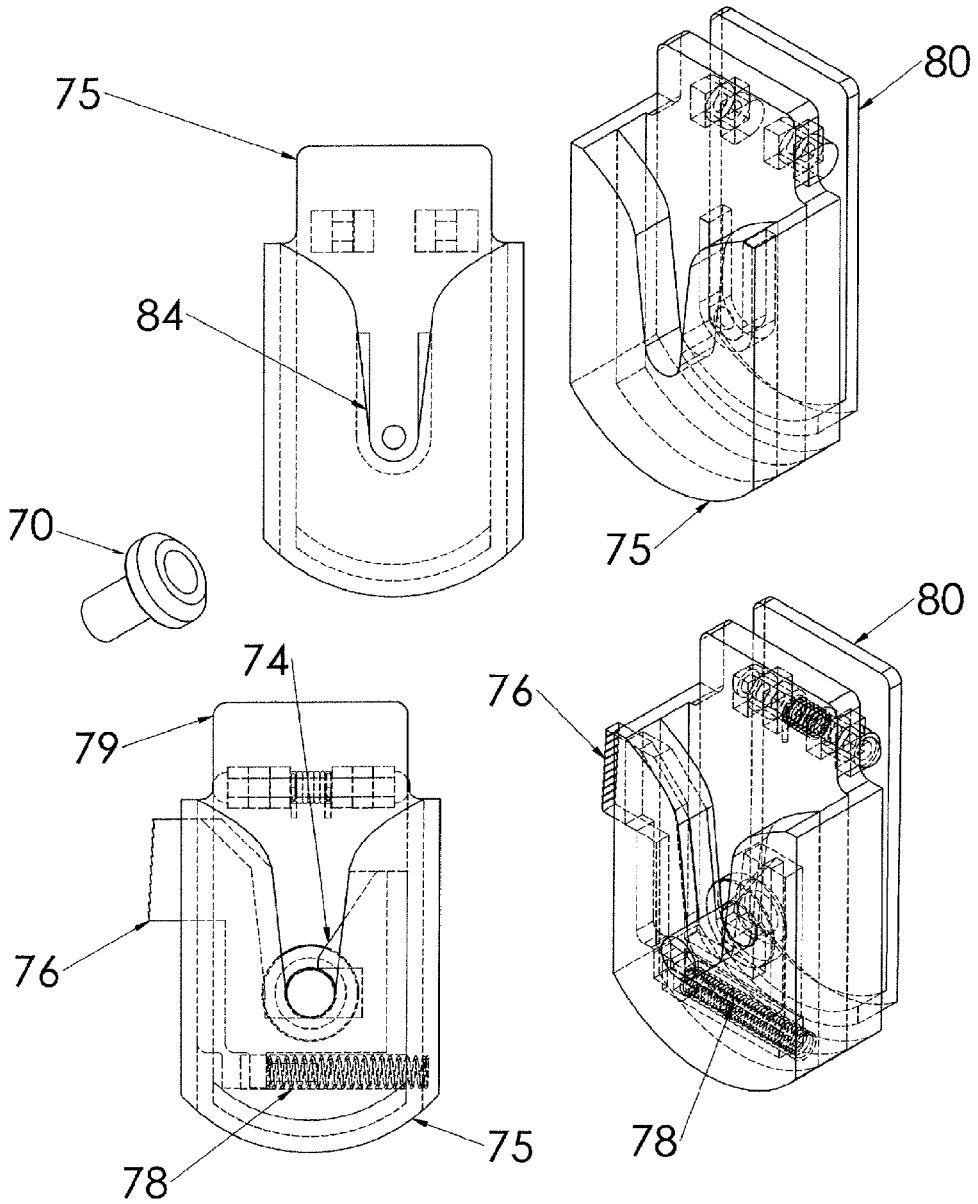
FIG. 37 is a view that has multiple views of a fourth embodiment of the apparatus of the present invention illustrating the receiver portion.
Figure 38:
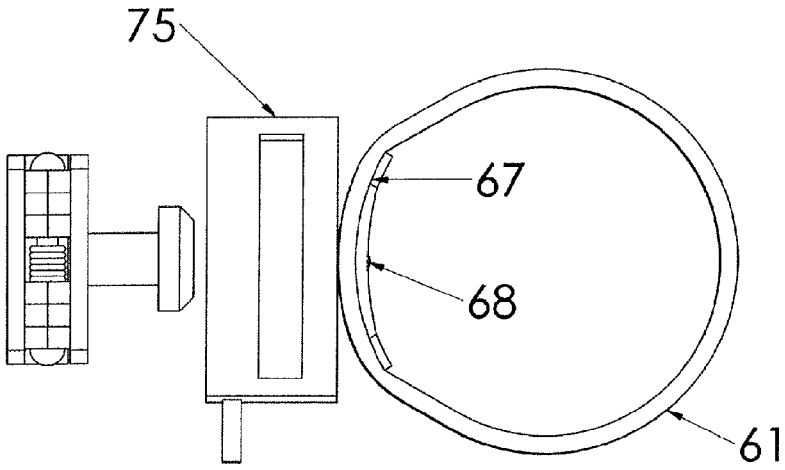
FIGS. 38-39 are fragmentary top (FIG. 38) and side (FIG. 39) views of a fourth embodiment of the apparatus of the present invention showing the receiver/holder/hanger wherein the receiver is attached to the sleeve and the projection or disk is attached to a wearer's belt, clothing item, or accessory.
Figure 39:
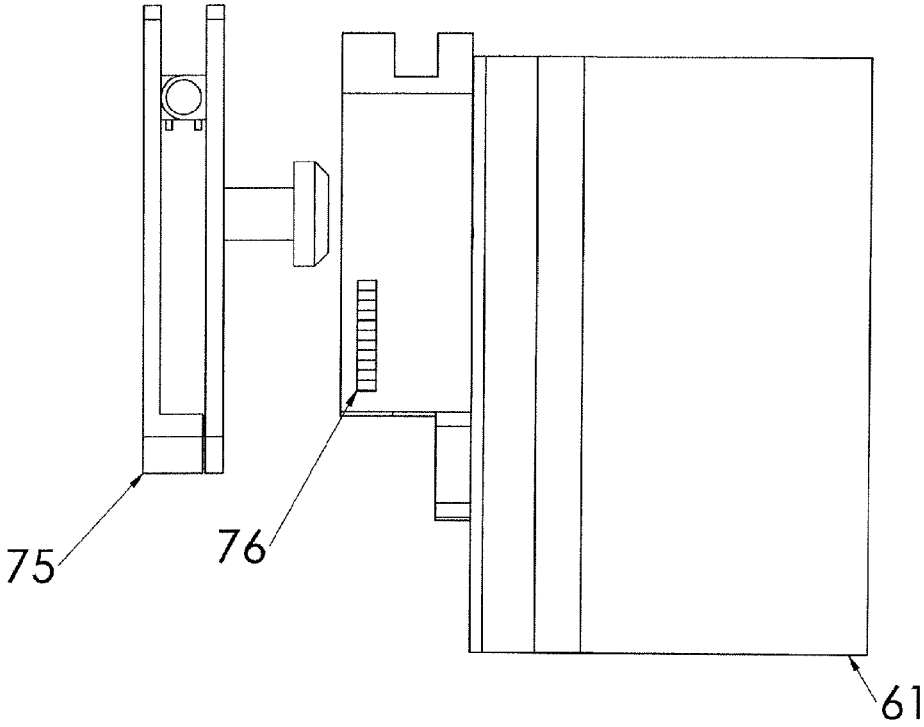
Figure 40:
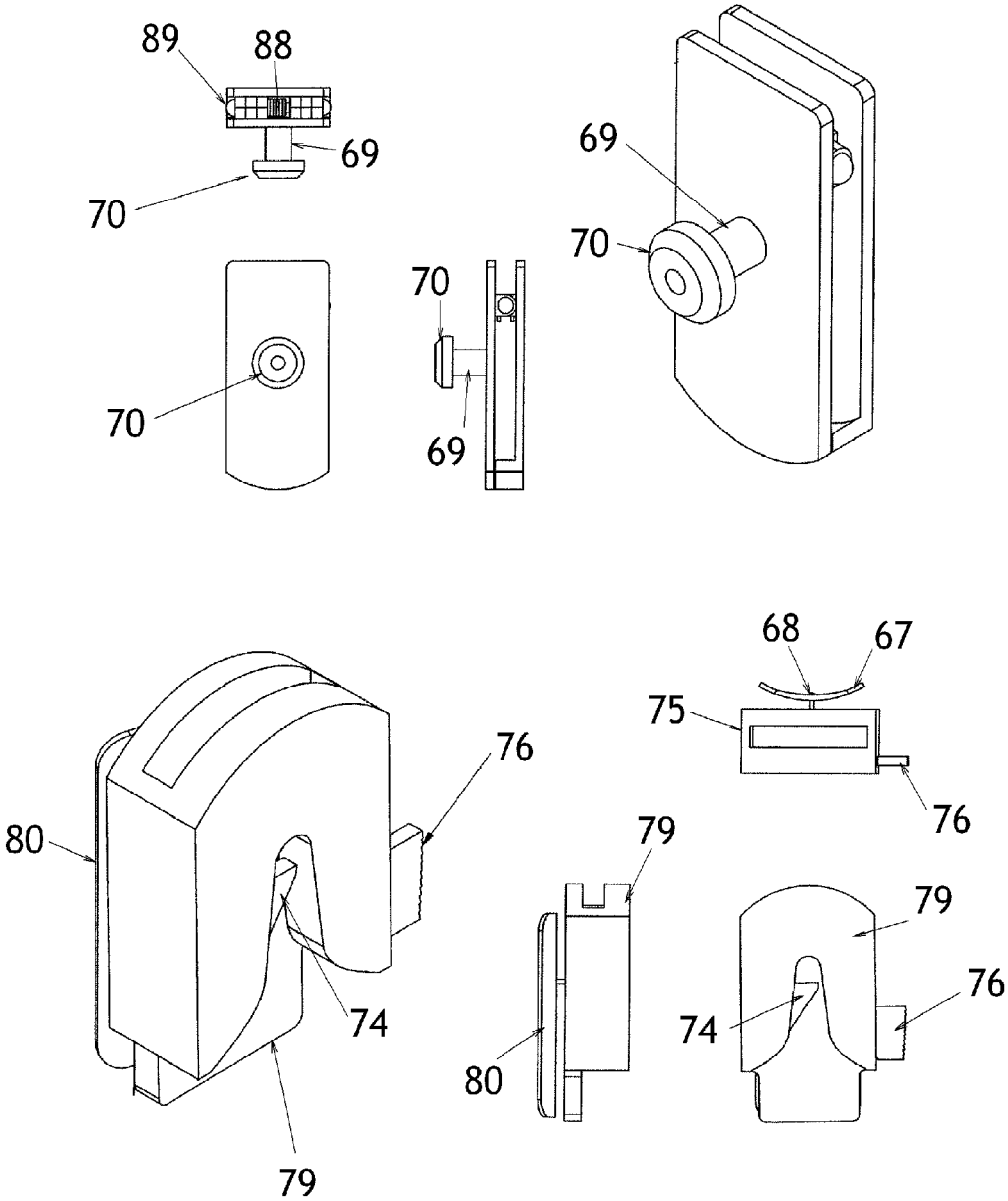
FIG. 40 contains fragmentary view of a third embodiment of the apparatus of the present invention.

In FIG. 36, locking plate 73 provides a cam 74, upwardly facing slot 77 and a spring carrier 82. When a user attempts to insert the combination of container or can 66, insulated sleeve 61 and projecting member 69 into socket 84 of receiver 75, the projecting member 69 strikes the cam 74 and overcomes the pressure of spring 78. The spring carrier 82 compresses the spring 78 as the connecting member 69 and disk 70 are forced downwardly in socket 84 and into slot 77. Eventually, the connecting portion 69 registers in horizontally extending slot 87 and cam 74 extends over the top of projecting member 69 in a locking position that is shown in FIG. 35.

In order to release the beverage container 66, insulated sleeve 61 and connecting portion 69 and disk 70, a user presses the release button 76 provided on locking plate 73 in order to compress spring 78 so that the cam 74 moves laterally away from the projecting member 69 allowing its release upwardly from socket 84 and receiver 75. Locking plate 73 travels laterally within housing section 79. Release button 76 extends through opening 81 and housing section 79.

Shoulders 85, 86 in FIG. 35 engage disk 70 as shown to prevent removable of disk 70 and projecting member 69 from receiver 75 unless release button 76 has been depressed.

Figure 41:
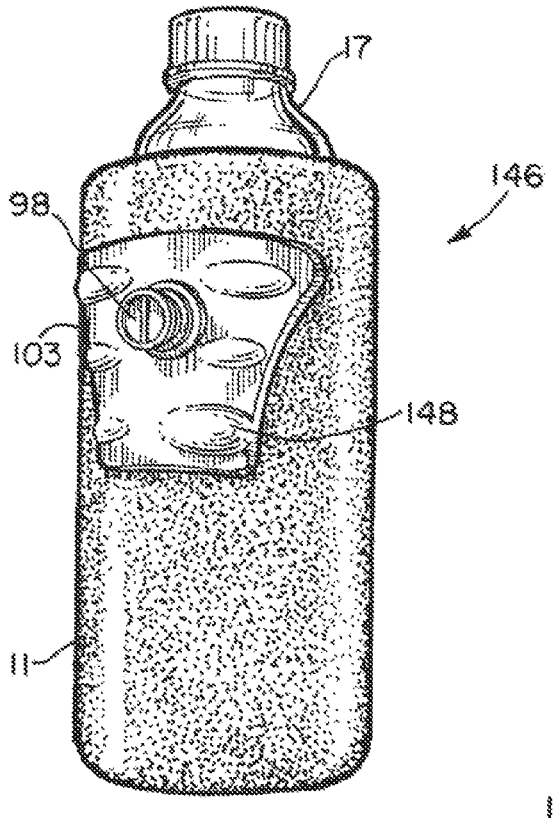
FIGS. 41-42 are perspective views of a fourth embodiment of the apparatus of the present invention.
Figure 42:
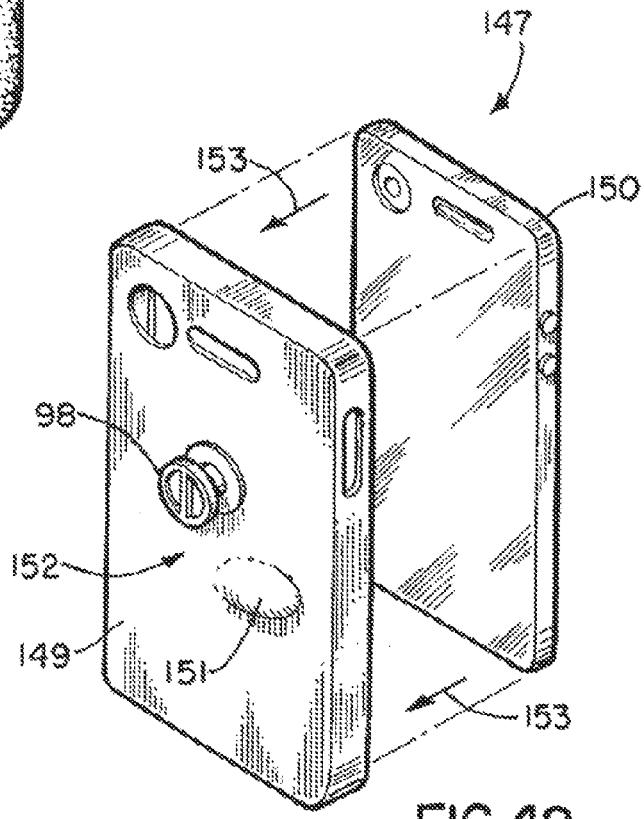
Figure 46:
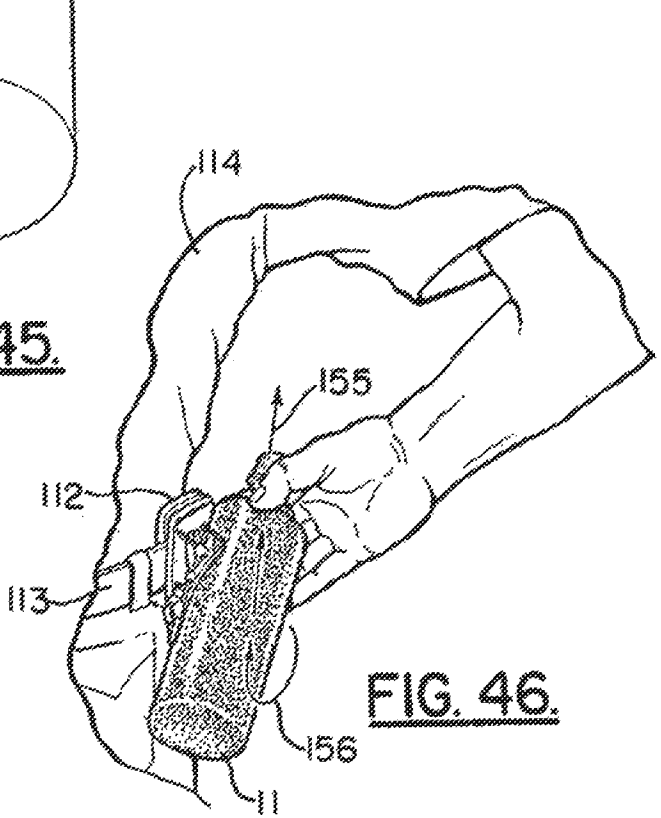
FIGS. 43-46 are sequential illustrations showing operation of the fourth alternate embodiment.
Figure 45:
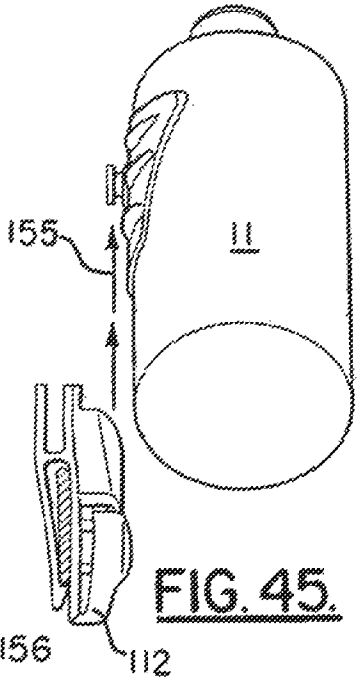
Figure 44:
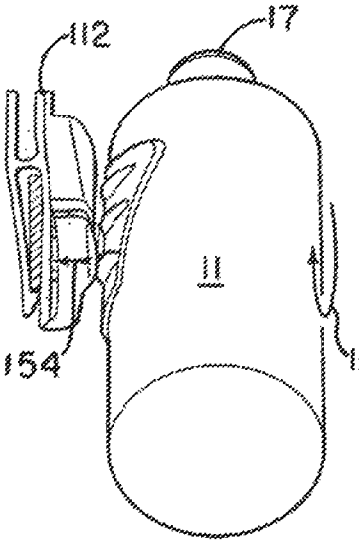
Figure 43:
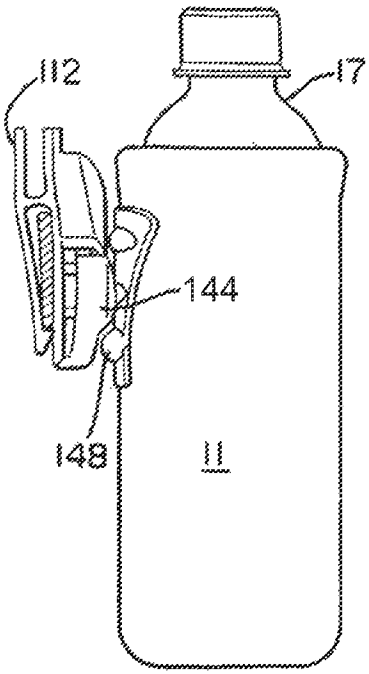

FIGS. 41-46 show an additional embodiment of the apparatus of the present invention designated by the numeral 146 in FIG. 41 and the numeral 147 in FIG. 42. In FIGS. 41, 43-46 there can be seen a beverage carry receptacle 146 having the same sleeve/insulated receptacle 11 for carrying a beverage or bottle 17 as with earlier embodiments. The outer curved plate 103 and projecting member 98 are of the same construction as shown in FIGS. 21-30. In FIG. 41 there is provided an enlarged cam or projection 148 which can be hemispherically shaped or other enlarged projection that has a curved outer surface projecting away from the plate 103 as shown in FIG. 41.

In FIG. 42, a mobile telephone carriage 147 is provided that includes case or receptacle 149 for receiving a mobile telephone 150 when the telephone 150 is moved into the case as illustrated by arrows 153 in FIG. 42. Case or receptacle 149 has a rear surface 152 with an enlarged cam or projection 151 which can be oval shaped or hemispherically shaped.

Either of the embodiments of FIG. 41 or 42 employ the same rotating mechanism to disconnect the sleeve 11 and its bottle 17 (or the combination of case 149 and telephone 150) from receptacle/holder/receiver 112. In order to effect such a disconnection, a user 114 rotates the combination of sleeve 11 and bottle 17 through an arch of about 30-45 degrees as illustrated by curved arrow 156 in FIGS. 44, 46. This rotation as illustrated by arrow 156 is in a clockwise direction when looking at the sleeve 11 with the receptacle 112 behind it. This rotating action causes the cam 148 (or 151 in the case of telephone 150 and its receptacle 149) to engage the actuator button 144 and depress it (illustrated by arrow 154 in FIG. 44). Such a depression of the actuated button 144 provides for release of the sleeve and bottle 11, 17 or telephone and case 149, 150 from the receptacle 112. The user then lifts the sleeve 11 from the receptacle 112, illustrated by arrows 155 in FIGS. 45, 46. If releasing case 149 with phone 150, the user rotates the combination of phone and case clockwise about 30-45 degrees to depress button 144 with cam 151 and lifts the case 149 and phone 150 upwardly.

The following is a list of parts and materials suitable for use in the present invention:

PARTS LIST:

| Number | Description |
|---|---|
| 10 | beverage carrier assembly |
| 11 | sleeve/insulated receptacle |
| 12 | cylindrical wall |
| 13 | circular bottom/panel |
| 14 | open top |
| 15 | interior |
| 16 | beverage container/can |
| 17 | beverage container/disposable bottle |
| 18 | beverage container/reusable bottle |
| 19 | inner curved panel/plate |
| 20 | outer curved panel/plate/hanger/connector |
| 21 | thickened section |
| 22 | flat surface |
| 23 | disk/projecting member |
| 24 | connecting portion/shaft |
| 25 | annular recess |
| 26 | fastener/screw/rivet/bolt/pin |
| 27 | arrow |
| 28 | arrow |
| 29 | zippered sleeve |
| 30 | receiver/holder/receptacle |
| 31 | housing |
| 32 | locking member/latch |
| 33 | pivot |
| 34 | upper end portion |
| 35 | projection |

-continued

PARTS LIST:

| Number | Description |
|---|---|
| 36 | lower end portion |
| 37 | cam |
| 38 | spring |
| 39 | spring attachment |
| 40 | recess/slot |
| 41 | arrow |
| 42 | user's finger/thumb |
| 43 | arrow |
| 44 | zipper |
| 45 | sleeve/bag |
| 46 | drawstring |
| 47 | recess |
| 48 | open top |
| 49 | arrow |
| 50 | flange |
| 51 | edge |
| 52 | housing/receiver |
| 53 | arm |
| 54 | receiver body |
| 55 | rotary connection/pivot |
| 56 | spring |
| 57A | arrow |
| 57B | arrow |
| 58 | socket |
| 59 | locking pin |
| 60 | beverage carrier |
| 61 | insulated sleeve |
| 62 | cylindrical wall |
| 63 | circular bottom |
| 64 | open top |
| 65 | interior |
| 66 | can/container |
| 67 | curved plate |
| 68 | fastener |
| 69 | projecting member/connecting portion |
| 70 | circular disk/projecting membrane |
| 71 | annular recess/groove |
| 72 | bottle |
| 73 | locking plate |
| 74 | cam |
| 75 | receiver |
| 76 | release button |
| 77 | slot |
| 78 | spring |
| 79 | housing section |
| 80 | housing section/clasp |
| 81 | opening |
| 82 | spring carrier |
| 83 | belt/clothing/accessory/recess |
| 84 | socket |
| 85 | shoulder |
| 86 | shoulder |
| 87 | horizontally extending slot |
| 88 | spring |
| 89 | pivot |
| 90 | beverage carrier assembly |
| 91 | insulated receptacle |
| 92 | cylindrical wall |
| 93 | circular bottom |
| 94 | open top |
| 95 | interior |
| 96 | beverage container/can/bottle |
| 97 | inner curved plate |
| 98 | projecting member |
| 99 | opening |
| 100 | arrow |
| 101 | outer annular flange |
| 102 | outer annular recess |
| 103 | outer curved plate |
| 104 | opening |
| 105 | circular portion |
| 106 | elongated slot |
| 107 | inner annular flange |
| 108 | inner annular recess |

-continued

PARTS LIST:

| Number | Description |
|---|---|
| 109 | tooth/projection |
| 110 | cylindrical portion |
| 111 | arrow |
| 112 | receptacle/holder/receiver |
| 113 | belt/clothing/strap |
| 114 | user/wearer |
| 115 | arrow |
| 116 | inner part |
| 117 | outer part |
| 118 | spring |
| 119 | hinge |
| 120 | push button |
| 121 | hook |
| 122 | opening |
| 123 | plate |
| 124 | opening |
| 125 | pin |
| 126 | ramp |
| 127 | triangular member |
| 128 | stop |
| 129 | pin |
| 130 | sleeve |
| 131 | bore/opening |
| 132 | cover |
| 133 | opening |
| 134 | curved front wall |
| 135 | slot |
| 136 | open top |
| 137 | bottom/stop |
| 138 | locking arm |
| 139 | upper end |
| 140 | arrow |
| 141 | arrow |
| 142 | arrow |
| 143 | slot |
| 144 | actuator button |
| 145 | arrow |
| 146 | beverage carry receptacle |
| 147 | mobile telephone carriage |
| 148 | projection/cam |
| 149 | case/receptacle |
| 150 | telephone |
| 151 | projection/cam |
| 152 | flat rear surface |
| 153 | arrow |
| 154 | arrow |
| 155 | arrow |
| 156 | curved arrow |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A beverage carriage for wear upon a user's body comprising:

a) an accessory that is attachable to a user's body;

b) a receiver that depends from the accessory, the receiver having an upwardly positioned socket;

c) a mounted sleeve having a top opening and an interior, said opening enabling a contained beverage to be housed within the sleeve interior;

d) a curved panel that fits inside the sleeve;

e) a projecting member attached to the curved panel and extending through the sleeve to a position spaced externally of the sleeve;

f) a detachable connector that joins the projecting member to the receiver when the detachable connector is lowered into the socket via the open top to define a pivotal connection;

g) a locking member that moves between locking and release positions, the locking member automatically interlocking with the connector when the connector is lowered into the socket, the locking member having a manually operated release portion that when depressed by the hand of a user places the locking member in the release position which enables removal of the connector from the socket; and h) a cam that depresses the release portion when the sleeve is rotated about said pivotal connection a selected number of degrees that is between about 5 degrees and 90 degrees.

2. The beverage carriage of claim 1 wherein the locking member is spring loaded.

3. The beverage carriage of claim 1 wherein the locking member has a cam that moves the locking member laterally away from the socket when the projecting member is lowered into the socket.

4. The beverage carrier of claim 1 wherein there is a second curved panel that attaches to the outside surface of the sleeve.

5. The beverage carrier of claim 1 wherein the projecting member has an annular flange and an annular recess.

6. The beverage carrier of claim 1 wherein the locking member is moved by the projecting member when the projecting member is joined to the receiver.

7. The beverage carrier of claim 1 wherein the locking member is positioned above the projecting member in the locking position.

8. The beverage carrier of claim 1 wherein the locking member moves laterally when the release portion is depressed.

9. The beverage carrier of claim 1 wherein the receiver has a cover and the locking member is a part of the cover.

10. A beverage carriage for wear upon a user's body comprising:

a) a receiver that is removably attachable to the user, the receiver having a socket;

b) a mounted sleeve having a top opening and an interior, said opening enabling a contained beverage to be housed within the sleeve interior;

c) a first panel that fits inside the sleeve, the sleeve being of a material that is softer than the first panel;

d) a projecting member attached to the first panel and extending through the sleeve to a position spaced externally of the sleeve;

e) a second panel that connects to the projecting member on the outside of the sleeve;

f) a connector that joins the projecting member to the receiver when the detachable connector is lowered into the socket via the open top to define a pivotal connection of the sleeve relative to the receiver;

g) a locking member that moves between locking and release positions, the locking member automatically interlocking with the connector when the connector is lowered into the socket, the locking member having as manually operated release portion that when depressed by the hand of a user places the locking member in the release position which release position enables removal of the connector from the socket; and h) a cam that depresses the release portion when the sleeve is rotated about said pivotal connection a selected number of degrees that is between about 5 degrees and 90 degrees.

11. The beverage carriage of claim 10 wherein the locking member includes a biasing means that biases the locking member towards a locking position.

12. The beverage carriage of claim 10 where when the projecting member is lowered into the socket, the locking member moves the locking member laterally away from the socket.

13. The beverage carrier of claim 10 wherein at least one of the panels has spikes that engage the sleeve.

14. The beverage carrier of claim 10 wherein the projecting member has an annular flange and an annular recess, the annular recess being closer to the sleeve than the annular flange.

15. The beverage carrier of claim 10 wherein the locking member is moved by the projecting member when the projecting member is joined to the receiver.

16. The beverage carrier of claim 10 wherein the locking member is positioned above the projecting member in the locking position.

17. The beverage carrier of claim 10 wherein the locking member moves laterally when the release portion is depressed.

18. The beverage carrier of claim 10 herein the receiver has a cover and the locking member is a part of the cover.

19. A beverage carriage comprising:

a) an accessory that is attachable to a user's body;

b) a receiver that depends from the accessory, the receiver having an upwardly positioned socket;

c) a mounted sleeve having a top opening and an interior, said opening enabling a contained beverage to be housed within the sleeve interior;

d) an inner panel that fits inside the sleeve;

e) a projecting member attached to the inner panel and extending through the sleeve to a position spaced externally of the sleeve;

f) an outer panel that attaches to the projecting member externally of the sleeve, and wherein the inner and outer panels sandwich the sleeve therebetween;

g) a detachable connector that joins the projecting member to the receiver to form a pivotal connection when the detachable connector is lowered into the socket via the open top; and h) a locking member that moves between locking and release positions, the locking member automatically interlocking with the connector when the connector is lowered into the socket, the locking member having an operated release portion that when depressed places the locking member in the release position which enables removal of the connector from the socket; and i) a cam that depresses the release portion when the sleeve is rotated at the pivotal connection a measure of between about 10 and 90 degrees.

20. The beverage carriage of claim 19 wherein the locking member is spring loaded.

* * * * *